US008328299B2

(12) United States Patent
Hashemi et al.

(10) Patent No.: US 8,328,299 B2
(45) Date of Patent: Dec. 11, 2012

(54) DRAWER SLIDE AND LOCKING MECHANISM

(75) Inventors: Darush David Hashemi, Trabuco Canyon, CA (US); Xiaoping Zhou, Baldwin Park, CA (US); Xiwen Wang, Hacienda Heights, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 156 days.

(21) Appl. No.: 12/768,669

(22) Filed: Apr. 27, 2010

(65) Prior Publication Data

US 2011/0069914 A1 Mar. 24, 2011

Related U.S. Application Data

(60) Provisional application No. 61/173,097, filed on Apr. 27, 2009.

(51) Int. Cl.
*A47B 95/00* (2006.01)

(52) U.S. Cl. ..... 312/333; 312/319.5

(58) Field of Classification Search ..... 312/319.5, 312/319.6, 319.7, 319.8, 333, 334.44, 334.47, 312/215, 222; 384/21; 70/85, 86, 87, 88, 70/275, 276, 277, 278.7, 280, 281, 282; 109/19, 109/68; 232/1 E, 43.4, 44; 220/476; 49/68; 292/194, 195, 197, 216, 219, 220, 224, 201
See application file for complete search history.

(56) References Cited

U.S. PATENT DOCUMENTS

| | | | | |
|---|---|---|---|---|
| 5,392,951 | A * | 2/1995 | Gardner et al. | 312/319.5 |
| 5,484,179 | A * | 1/1996 | Mader | 292/336.3 |
| 5,518,282 | A | 5/1996 | Sawada | |
| 5,791,179 | A * | 8/1998 | Brask | 70/278.1 |
| 6,318,136 | B1 * | 11/2001 | Mauer | 70/276 |
| 6,923,480 | B2 * | 8/2005 | Shafry | 292/201 |
| 7,131,673 | B2 | 11/2006 | Cherry et al. | |
| 7,165,428 | B2 * | 1/2007 | Isaacs et al. | 70/278.1 |
| 7,458,651 | B1 * | 12/2008 | Radke et al. | 312/333 |
| 7,731,250 | B2 | 6/2010 | Garneau et al. | |
| 7,766,397 | B2 | 8/2010 | Carabalona | |
| 2002/0139157 | A1 * | 10/2002 | Butera et al. | 70/256 |
| 2005/0127683 | A1 * | 6/2005 | Nam | 292/96 |

(Continued)

FOREIGN PATENT DOCUMENTS

| | | |
|---|---|---|
| JP | 08-289821 | 11/1996 |

(Continued)

OTHER PUBLICATIONS

Machine Translation of KR 20-0440074.*

(Continued)

*Primary Examiner* — James O Hansen
*Assistant Examiner* — Sasha T Varghese
(74) *Attorney, Agent, or Firm* — Klein, O'Neill & Singh, LLP

(57) ABSTRACT

A drawer slide with lock mechanism has an elongated outer slide member extendably coupled to an inner slide member. A latch arm or pin is fixed to the inner slide member for latching by a lock mechanism fixed to the outer slide member. The lock mechanism uses a latch receiver that rotates with respect to the lock mechanism and is in a travel path of the latch arm. A lever arm rotates with respect to the lock mechanism and is positionable to block rotation of the latch receiver in a locked position to retain the latch arm. A motor drives a cam to position the lever arm to free the latch receiver from the locked position.

23 Claims, 17 Drawing Sheets

U.S. PATENT DOCUMENTS

| | | | | |
|---|---|---|---|---|
| 2006/0267461 | A1* | 11/2006 | Hoffman | 312/219 |
| 2007/0159038 | A1* | 7/2007 | Huang | 312/333 |
| 2008/0231154 | A1* | 9/2008 | Rudduck et al. | 312/333 |
| 2008/0246286 | A1* | 10/2008 | Ostrowski | 292/144 |
| 2009/0235767 | A1 | 9/2009 | Garneau et al. | |
| 2011/0056253 | A1 | 3/2011 | Greiner et al. | |
| 2011/0227351 | A1 | 9/2011 | Grosdemouge | |

FOREIGN PATENT DOCUMENTS

| | | |
|---|---|---|
| JP | 10-215960 | 8/1998 |
| KR | 20-0440074 | 5/2008 |

OTHER PUBLICATIONS

International Search Report on related PCT application (PCT/US2010/032623) from International Searching Authority (KIPO) dated Jan. 28, 2011.

Written Opinion on related PCT application (PCT/US2010/032623) from International Searching Authority (KIPO) dated Jan. 28, 2011.

* cited by examiner

DRAWER SLIDE AND LOCKING MECHANISM

CROSS REFERENCE TO RELATED APPLICATIONS

This application claims the benefit of the filing date of U.S. Provisional Patent Application No. 61/173,097, filed Apr. 27, 2009, the disclosure of which is incorporated by reference.

BACKGROUND OF THE INVENTION

The present invention relates generally to drawer slides, and more particularly to drawer slides with locking mechanisms.

Drawer slides are often used to extendably couple drawers within cabinets or racks within frames. Using a cabinet application as an example, drawer slides generally have one member mounted to a drawer and another member mounted to a cabinet. The two members are extendably coupled together, often by way of ball hearings, so that the extension of the drawer slide provides for extension of the drawer from the cabinet, allowing for easy access to the contents of the drawer.

Unfortunately, uncontrolled easy access to contents of a drawer is not always desired. A drawer may contain items of a personal nature, or, as may often be the case in a commercial setting, the drawer may contain valuable items. Secure storage of such items may be an important consideration, and drawer slides, with the ease of access they provide, may not be an appropriate.

More secure storage, for example as provided by a safe or a lock box, may also not always be appropriate. At times frequent and repeated access to stowed items may be required, albeit in a controlled manner. Moreover, structures associated with safes and lock boxes may be somewhat bulky, and not easily incorporated in a cabinet type structure which otherwise may be desired.

BRIEF SUMMARY OF THE INVENTION

Aspects of the invention provide a drawer slide and lock mechanism. In one aspect of the invention, the invention provides a drawer slide with lock mechanism, comprising: an outer slide member with an elongate web bounded by raceways; an inner slide member nested within the raceways and having a latch arm, the inner slide member extendible with respect to the outer slide member; a latch receiver rotatably mounted with respect to the outer slide member in a travel path of the latch arm; a lever arm rotatably mounted with respect to the outer slide member, the lever arm rotatable to a position to block rotation of the latch receiver in at least a first direction; and a motor drivably coupled to the lever arm to rotate the lever arm in at least one direction.

In another aspect of the invention, the invention provides a locking drawer slide, comprising: a first slide member; a second slide member extendably coupled to the first slide member along a first axis; a pin extending from the second slide member substantially perpendicular to the first axis; and a latch receiver pivotably fixed with respect to the first slide member, the latch receiver positionable in an open position for receiving the pin and positionable in a closed position for retaining the pin; a lever arm pivotably fixed with respect to the first slide member, the lever arm positionable in a release position for allowing pivoting of the latch receiver and positionable in a locking position for holding the latch receiver in the closed position by blocking rotation of the latch receiver toward the open position; a cam arranged to pivot the lever arm by pushing a cam follower portion of the lever arm; and a motor rotationally coupled to the cam.

In another aspect of the invention, the invention provides a locking drawer slide, comprising: a first slide member; a second slide member extendably coupled to the first slide member along a first axis; a pin extending from the second slide member substantially perpendicular to the first axis; and a latch receiver pivotably fixed with respect to the first slide member, the latch receiver positionable in an open position for receiving the pin and positionable in a closed position for retaining the pin; a first spring configured to bias the position of the latch receiver towards the open position; a lever arm pivotably fixed with respect to the first slide member, the lever arm positionable in an release position for allowing pivoting of the latch receiver and positionable in a locked position for holding the latch receiver in the closed position by blocking rotation of the latch receiver toward the open position; a second spring configured to bias the position of the lever arm towards the locked position; and a shape memory alloy wire attached to the lever arm and arranged to pull the lever arm to the release position when heated.

These and other aspects of the invention are more fully comprehended upon review of this disclosure.

DETAILED DESCRIPTION

Figures 1, 2:
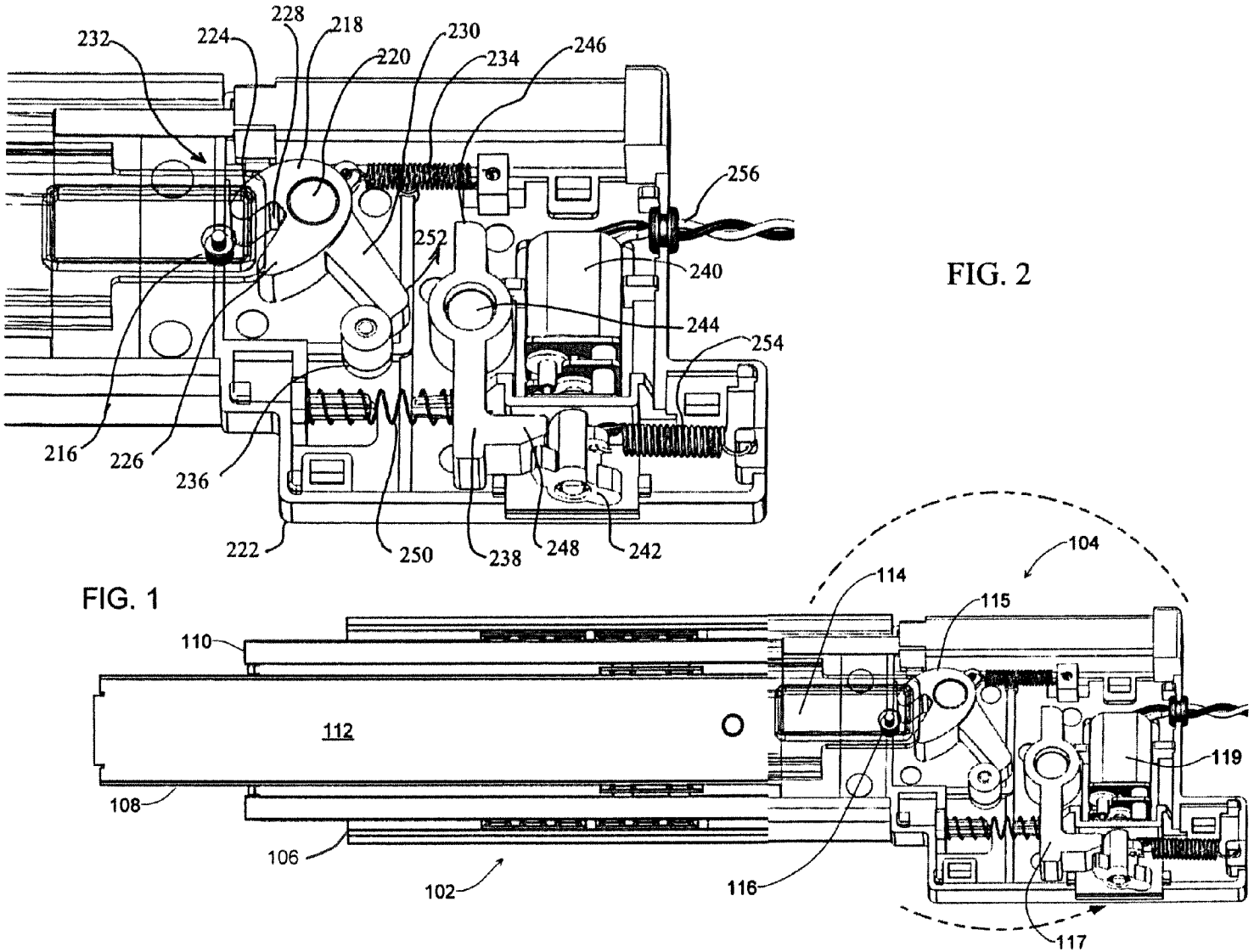
FIG. 1 illustrates a drawer slide with a lock mechanism in accordance with aspects of the invention.
FIG. 2 shows a magnified view of portions of FIG. 1.

FIG. 1 illustrates a view of a drawer slide 102 with a lock mechanism 104 in accordance with an embodiment of the present invention. Generally, in the embodiment of FIG. 1, a latch arm is positioned on a portion of a drawer slide member that is intended to be mounted to and move with a drawer and a latch receiver 115 is coupled to a drawer slide that is intended to be mounted to and maintain position of a cabinet. As illustrated the latch receiver is coupled to a portion of a drawer slide member intended to be mounted to a cabinet, although in some embodiments the latch receiver may be mounted to the cabinet. In most embodiments, the latch receiver and the lock mechanism are dimensioned so as to be operable in an operating envelope of the drawer slide, and in some embodiments are within the operating envelope of the drawer slide. The operating envelope of the drawer slide is generally a space having a width less than or equal to spacing between a cabinet wall and a drawer and having a height of approximate or less than a height of a drawer. In some embodiments, the thickness of the lock mechanism, and/or the components comprising component of the lock mechanism, is approximately ½ inch.

The latch receiver receives the latch arm when the drawer slide is in or approximate a closed position. The latch receiver is maintained in a locking position by a lever arm 117, which is moveable between a locking position and an unlocking position by activation of a motor 119. In some embodiments the latch receiver is maintained in the locking position by engagement with a top of the lever arm. In some embodiments the latch receiver is biased towards an open or unlocked position by a spring. Movement of the lever arm to the unlocking position, for example using a motor and associated driving mechanism, releases the latch receiver to the unlocking position.

As illustrated in the embodiment of FIG. 1, the drawer slide 102 is a three member telescopic drawer slide, with an outer slide member 106 configured for mounting to a cabinet, an inner slide member 108 configured for mounting to a drawer, and an intermediate slide member 110 coupled between the outer slide member and the inner slide member. Each of the three slide members include a longitudinal web (with for example the longitudinal web of the inner slide member 108 identified by reference numeral 112) with bearing raceways along the length of the web. In various embodiments, greater or fewer numbers of slide members are used, and in various embodiments different types of drawer slide members may be used, for example over and under slides, undermount slides, friction slides, or other types of slides.

The three drawer slide members, which are slidably or rollably coupled by way of ball bearings in many embodiments, are arranged with the intermediate slide member nested within the outer slide member, and the inner slide member in turn nested within the intermediate slide member. When mounted to a cabinet and a drawer, with the slide in the closed position the intermediate slide member and the inner slide member are substantially within the volume of the outer slide member.

The inner slide member carries a pin 116 that extend from the web of the inner slide member and towards the web of the intermediate slide member. As shown in the embodiment of FIG. 1, the pin extends from an extension 114 of the web of the inner slide member. The extension 114 (shown partially clear for clarity) extends about a rear of the inner slide member. The extension in some embodiments, and as illustrated in FIG. 1, has a longitudinal width less than a latitudinal width of the longitudinal web of the inner slide member.

The pin may be welded or otherwise attached to the extension of the inner slide member, for example by riveting, with the pin being a rivet. In other embodiments the pin may be formed of the material of the inner slide member, and may for example be in the form of a post or other form punched or pressed from the material of the inner slide member.

The lock mechanism includes components configured to work in combination to capture the pin within the latch receiver and secure the inner slide member in the closed or locked position. Conversely, the components of the lock mechanism may also be activated to release the pin from the latch receiver and thus, release the inner slide member to allow it to return to the open position. The latch receiver captures the pin, such that the pin, and therefore the inner slide member, is prevented from moving to an open position. Thus, the pin may be considered a latch arm, and the pin and the latch receiver may together be considered a latch.

As shown in the embodiment illustrated in FIG. 2, which shows a magnified view of portions of the embodiment of FIG. 1, a lock mechanism includes a latch receiver 218 rotatably mounted using a screw or rivet 220 to a housing base 222. Alternately, in some embodiments the latch receiver may be mounted to an outer slide member or a cabinet frame. The latch receiver is generally U-shaped, defined by two legs that extend from the latch receiver, a first leg 224 and a second leg 226, with the first and second legs defining a basin 228 therebetween for receiving the pin. A third leg 230 extends from one side of the of the generally U-shaped latch receiver approximately perpendicular to the basin. In the open or unlocked position the opening of the basin faces towards a "front" end 232 of the lock mechanism. In this position, a pin 216 is allowed to move in or out of the basin, thus permitting forward movement or extension of the inner slide member, and therefore opening of the drawer coupled to the inner slide member.

In the embodiment of FIG. 2, the latch receiver 218 is biased to the open or unlocked position by a first spring 234. The first spring is coupled to the latch receiver at a position approximately on the opposite side of the latch receiver relative to the basin. The first spring is coupled at its other end to the housing base via a stanchion or post extending therefrom to provide a counteraction to create a spring force when the latch receiver is rotated to the closed position, with the first spring therefore biasing (rotating) the latch receiver to the open position. A bumper 236 is positioned to engage the third leg of the latch receiver when the latch receiver is in the open position. Preferably the bumper includes a soft compliant shell, for example of rubber, to reduce noise generated by contact of the third leg and the bumper. The bumper is positioned such that its engagement with the third leg counters the bias from the first spring to cause the latch receiver to stop rotating as the basin is positioned to receive the pin. The constant biasing of the latch receiver by the first spring and the counteraction of this bias by the third lea against the bumper ensures that the latch receiver is held in place and does not inadvertently move out of position. With reference also to FIG. 1, closing of the drawer slide assembly causes the pin 116 to engage the latch receiver and force the inner slide member and the latch receiver into the closed or locked position. During closure of the drawer slide assembly the opening of the basin is rotated approximately perpendicular to direction of travel of the drawer slide 102 with the pin captured within the basin between the first and second legs. While in this position, the first leg of the generally U-shaped latch receiver prevents forward movement of the pin, and therefore prevents forward movement of the inner slide member and drawer.

Referring again to FIG. 2, the lock mechanism also includes a drive assembly that is used to release pin from the latch receiver upon activation of the drive assembly. The drive assembly components include a lever arm 238, a motor 240 and a motor cam 242. A lever arm 238 is positioned by the drive assembly for locking and unlocking the latch receiver.

The lever arm is substantially flat and generally of rectangular shape. A hole 244 is defined on the lever arm at approximately a third of the length from a top edge 246 of the lever arm, for insertion of a pin or rivet for mounting to the housing base. The pin or rivet provides a fulcrum for the lever arm upon which to rotate. A cam follower 248 is formed at the opposite end from the top edge of the lever arm and is configured to engage with the motor cam.

The lever arm is biased to a ready or "locking" position shown in FIG. 2, with a top of the lever arm in the travel path of the third leg 230 of the latch receiver, by a second spring 250. When in the ready position, the second spring also biases the cam follower against the motor cam. In one embodiment, the surface of motor cam is designed such that in one cycle (e.g. quarter turn, half turn) of the operation of motor the motor cam rotates to a camming position, pushing on the surface of the cam follower an amount sufficient to rotate the lever arm out of the travel path 252 of the third leg. Upon deactivation of the motor, the motor cam may be rotated back to an uncammed position using a third spring 254. The third spring is coupled to the motor cam and a stanchion so as to bias the motor cam to an uncammed position. Upon deactivation of the motor, the third spring overcomes drag of the unactivated motor to return the motor cam to the uncammed position. In addition, in some embodiments, and as illustrated in FIG. 2, the motor cam includes a camming stop and an uncammed stop, both in the form of arms extending from the motor cam. The stops serve to prevent over rotation of the cam, in the cammed and uncammed positions, respectively.

The motor cam operationally engages the cam follower to rotate the lever arm to an open position, with the top edge of the lever arm being moved away from a locking engagement with the third leg of the latch receiver. The motor cam is operationally coupled to motor such that rotation of the motor causes the motor cam to push against the cam follower to overcome the spring force provided by the second spring and the third spring, and rotate the lever arm such that the third leg of the latch receiver clears the top of the lever arm.

The motor 240 is powered via electric wiring 256. Power may be supplied to the motor by or through batteries, or power outlets commonly found in residential or commercial settings, with the power supplied by a utility or back-up generator or the like. The motor may be any motor with sufficient torque capability to overcome spring or other forces to rotate the lever aim when desired. For example, the motor may be a gear motor, stepper motor and the like.

Generally, the motor is activated when desired with the use of a button, switch or similar device. In some embodiments drive circuitry for the motor may be provided, which may be activated by entry of a password or identification number by way of a keypad, by a signal, preferably encoded, from a wireless transmitter, or by some other way of receipt of a signal, preferably coded, indicating authorized opening of the drawer is requested.

Figure 3:
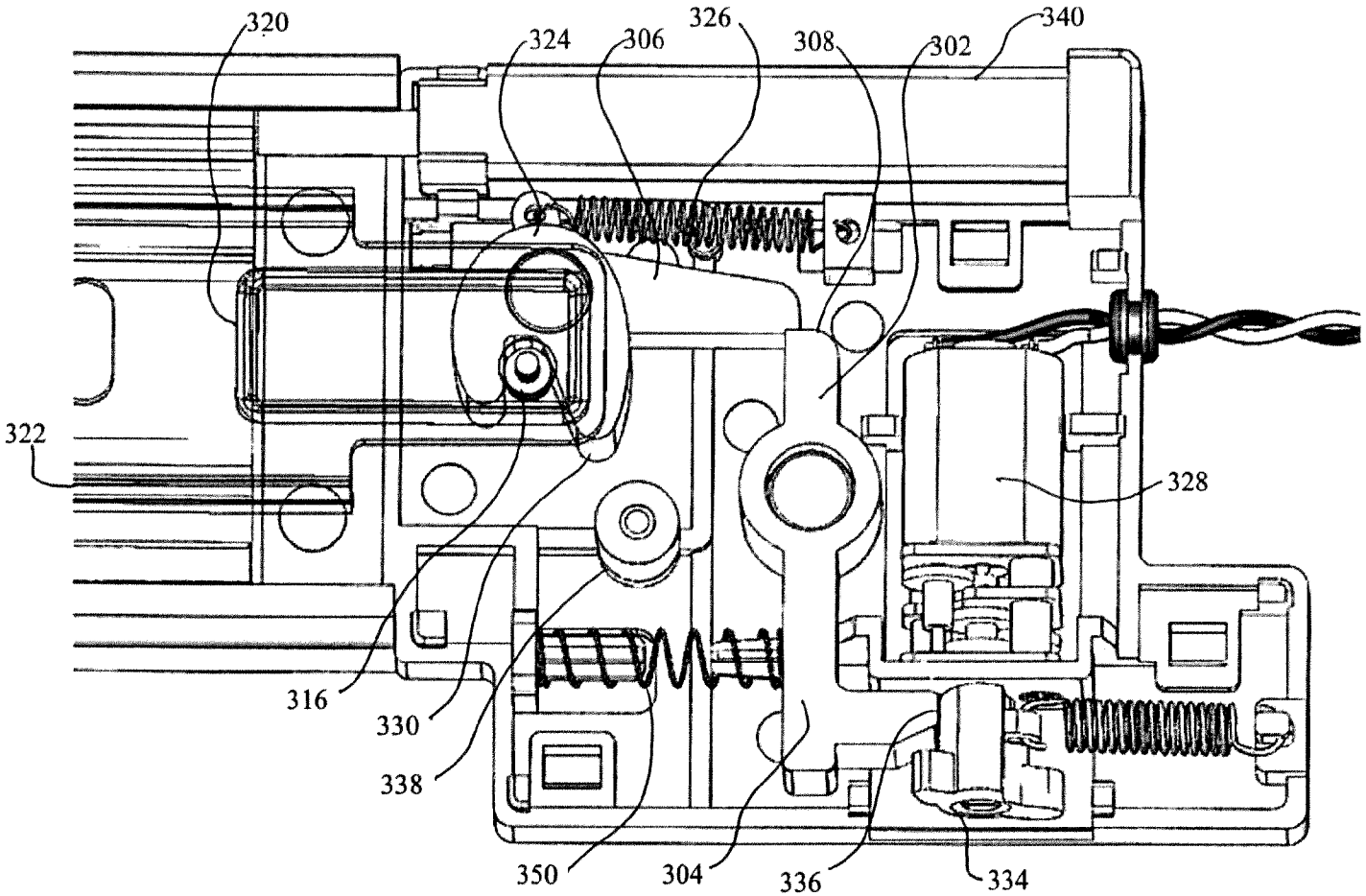
FIG. 3 illustrates the device of FIG. 1 in a locking position.

FIG. 3 is an illustration of the device of FIG. 2 in a locking position in accordance with an embodiment of the invention. For example, when access to the contents of the drawer is complete, a user may close the drawer, closing the drawer slide, causing the inner slide member to move toward the lock mechanism. As in FIG. 2, a pin 316 extends perpendicularly from a rear position of a web 320 of an inner slide member 322 of a drawer slide assembly. A latch receiver 324 is positioned in a travel path of the pin, with the latch receiver including a basin for receiving the pin. As illustrated in FIG. 3, the pin is in the basin of the latch receiver. The latch receiver is normally biased by a first spring 326 to an open position, with the basin positioned to receive the pin, with the movement of the pin overcoming the first spring bias to rotate the latch receiver to a closed position. The latch receiver is maintained in the closed position as shown in FIG. 3, by a lever arm 302, which, upon activation of a motor 328, releases the latch receiver.

Accordingly, as the inner slide member is moved towards the closed position the pin reaches the basin of the latch receiver. As the user continues to slide the drawer closed, the pin is forced against a second leg 330 of the generally U-shaped latch receiver, which is in the travel path of the pin. The force of the pin against the second leg overcomes the bias of first spring to rotate the latch receiver from the open or unlocking position to the closed or locking position shown in FIG. 3.

Rotation of the latch receiver causes a third leg 306 of the latch receiver to also rotate away from the bumper. As shown in FIG. 3, the lever arm is in the travel path of the third leg of the latch receiver. Accordingly, the third leg of the latch receiver contacts or bumps the lever arm while rotating. However, the rotational force provided by the pin against the second leg of the latch receiver is sufficient to overcome the spring force provided by a second spring 350 engaged with and holding the lever arm in its ready or locking position relative to the latch receiver. A top end of the lever arm 302 is therefore pushed out of the way by the third leg and made to rotate about the fulcrum, or pivot point. The rotation of a bottom end of the lever arm 304 causes the second spring to be compressed.

As shown in FIG. 3, however, due to the bias created by the compressed second spring against the bottom end of the lever arm, the lever arm returns to the locking position after the third leg has cleared a top edge of the lever arm 308. Engagement between the top edge of the lever arm and the bottom edge of the third leg prevents the latch receiver from rotating back to the open position, thus locking the pin, the inner slide member, and the drawer in a closed position.

Upon activation of the motor, for example, by the depression of a button, the throwing of a switch, after drive circuitry receives a coded signal and the like, the latch receiver is returned to its open position. Activation of the motor rotates a motor cam 334. The engagement between the surface of the motor cam and the surface of a cam follower 336 of the lever arm is done with sufficient force to overcome the bias of the second spring and any friction between the top edge of the lever arm and the bottom edge of the third leg to rotate the lever arm about its pivot point. The rotation of the lever arm moves the top edge of the lever arm out of the travel path of the third leg of the latch receiver. With the third leg free from contact with the lever arm, the first spring biases the latch receiver to the unlocking position, swinging the third leg along its travel path until the third leg once again engages with a bumper 338 to stop the rotation. The pin, and therefore the inner slide member and drawer, are free to move to a forward extended position.

Forward movement of the pin is assisted by a compression spring (not shown) in a housing 340. The compression spring has an end coupled to a plunger, which bears against an intermediate slide member of the drawer slide assembly. As the drawer slide is closed, the intermediate slide member, via the shaft, compresses the compression spring. Once the latch receiver releases the pin, the compression spring provides an open-assist force pushing the intermediate slide member, and therefore the inner slide member and drawer, towards an open position.

Figure 4:
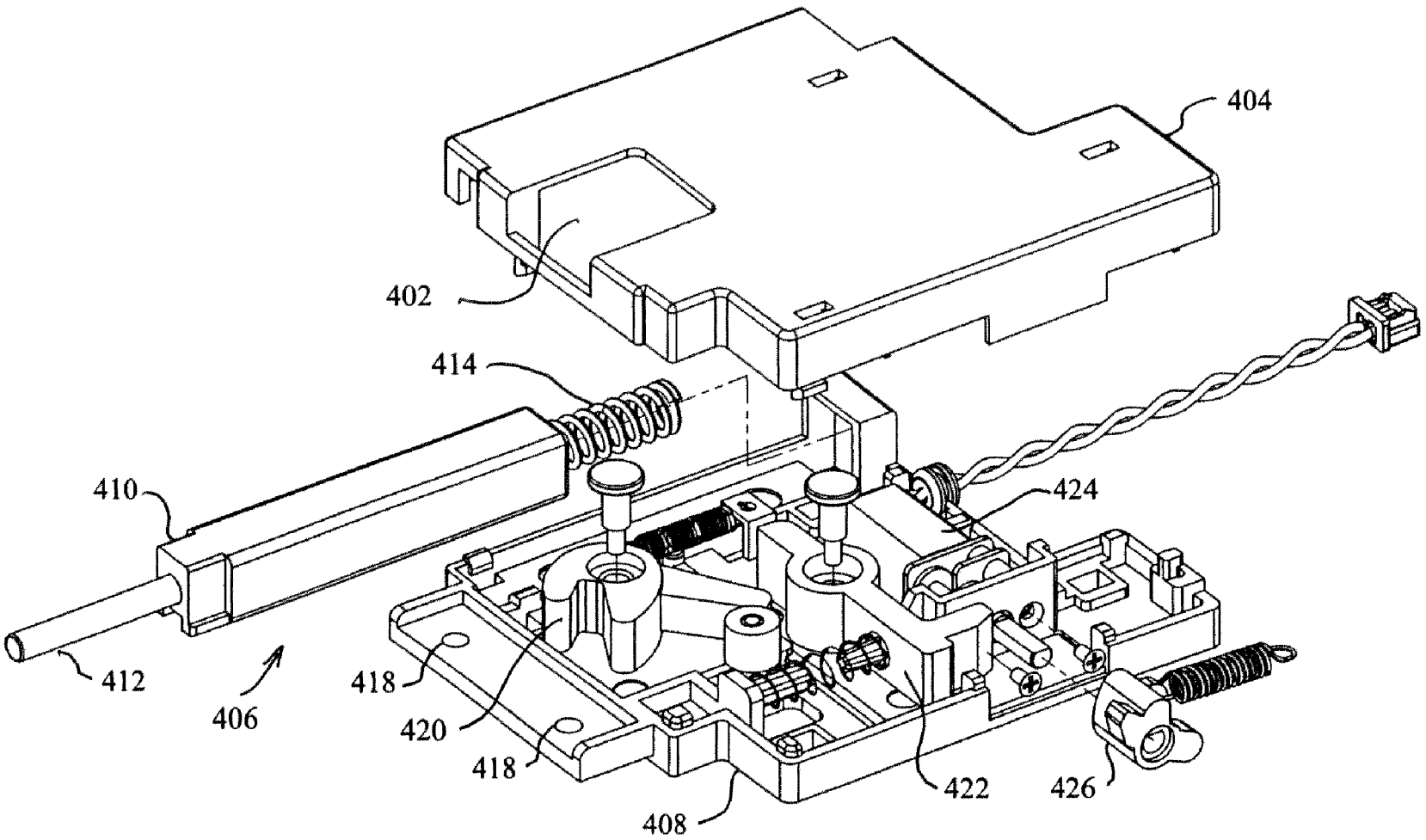
FIG. 4 illustrates a semi-exploded view of an assembly including a lock mechanism in accordance with aspects of the invention.

FIG. 4 is a semi-exploded view of an assembly including a lock mechanism in accordance with an embodiment of the present invention. A housing includes a cover 404 and a base 408, and the housing may, for example, be used to house the lock mechanism of FIGS. 1, 2, and 3. The housing is configured for mounting to a drawer slide member or cabinet, for example using mounting holes 418. The housing is in some embodiments thin, for example, approximately ½ inch, in the direction normal to webs of an associated drawer slide to facilitate use of a housed lock mechanism in an operating envelope of a drawer slide. The cover includes an open slot 402. As illustrated in FIG. 4, the open slot is about a forward edge of the cover, and the open slot provides access to the inner components of the lock mechanism to facilitate engagement therewith. When the inner slide member approaches the lock mechanism so as to be in the closed position, an extension of an inner slide member is received into the open slot. A latch receiver 420 disposed below the cover and about the open slot is configured to capture a pin on the inner slide member, such that the pin, and therefore the inner slide member, is prevented from moving to an open position.

In the embodiment of FIG. 4, the lock mechanism includes the latch receiver, a lever arm 422 for locking the latch receiver in a closed or locked position, and a motor 424 and cam 426 for rotating the lever arm so as to release the latch receiver.

An automated open-assist mechanism 406 is provided within the housing to provide an open-assist feature for the drawer slide and drawer. In one embodiment, the open-assist mechanism is positioned in the housing so as to engage a portion of a drawer slide assembly, for example an intermediate slide member. The open-assist mechanism includes a spring housing 410 which incorporates a plunger 412 coupled to a biasing member 414, such as a spring. Operationally, in one embodiment, upon closing of the drawer slides, the plunger is contacted by the intermediate slide member, which causes the plunger to compresses the biasing member within the housing. The biasing member therefore biases the intermediate slide member forward while the inner slide member is locked in position. When the latch receiver moves to the unlocked position, however, the bias provided by the biasing member pushes the intermediate slide member via the plunger, forward, carrying the inner slide member and drawer forward to at least a slightly open position.

Figure 5:
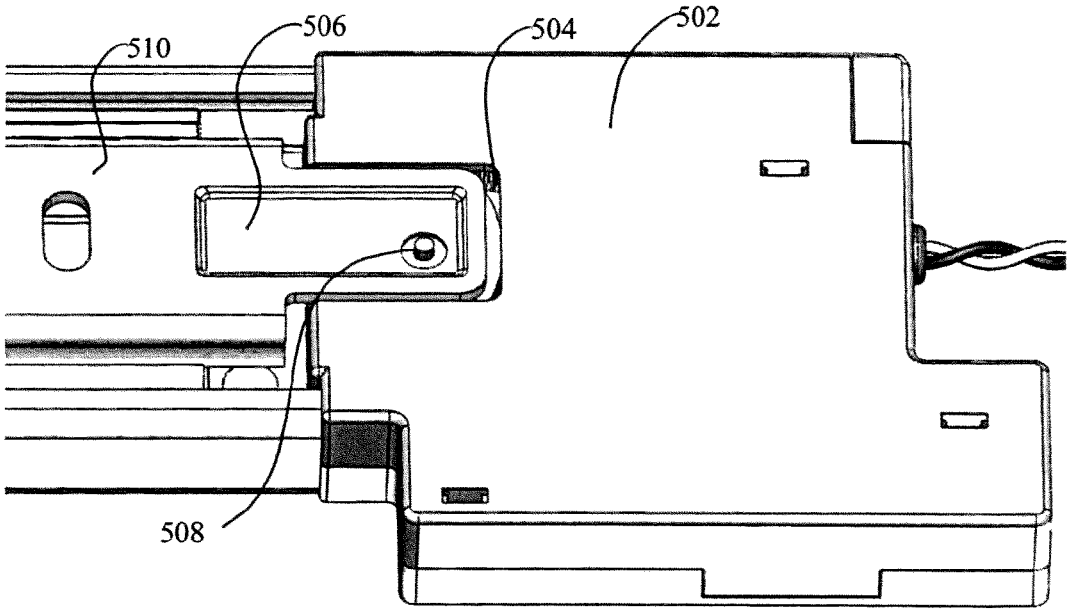
FIG. 5 is a front view of a housing for a lock mechanism coupled to a drawer slide assembly in accordance with aspects of the invention.

FIG. 5 is a view including a front of a housing for a lock mechanism coupled to a drawer slide assembly. As illustrated, the drawer slide assembly is in the closed or locking position. In this embodiment, a top cover 502 includes an open slot 504 to receive an extension 506 of an inner slide member 510. The extension carries a pin 508 which engages a latch member positioned below the top cover and within an outline defined by the open slot.

Figure 6:
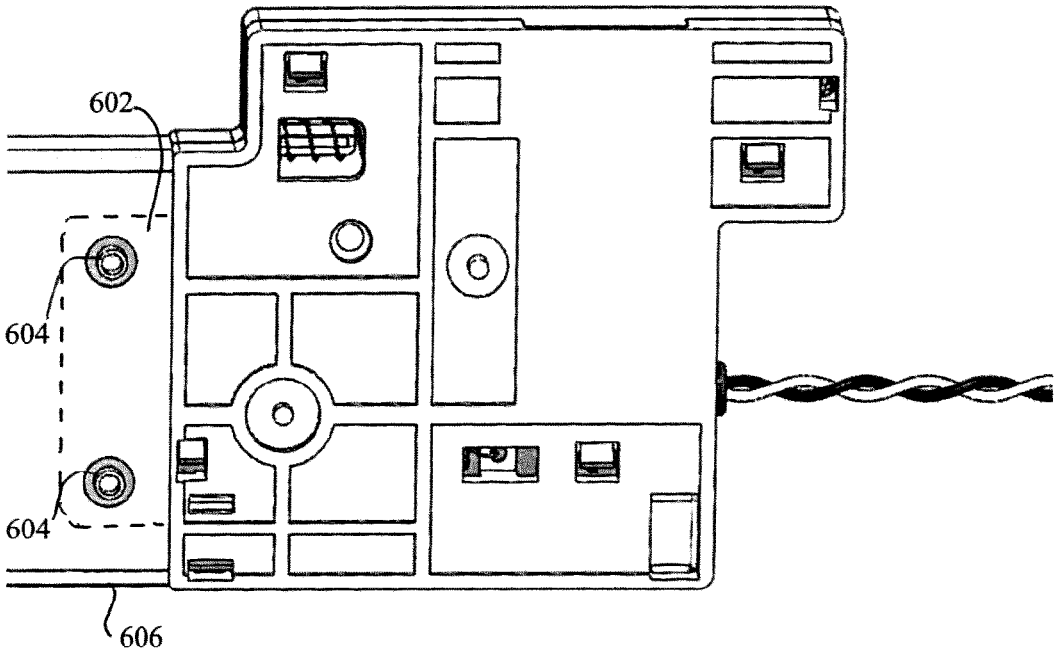
FIG. 6 is a back view of a housing for a lock mechanism coupled to a drawer slide assembly in accordance with aspects of the invention.

FIG. 6 is a view including a back of a housing for a lock mechanism in accordance with an embodiment of the present invention coupled to a drawer slide assembly. As shown, the housing includes an extended lip portion 602 (shown in phantom) that includes two mounting holes for receiving screws, bolts, rivets, or the like 604 used to couple the extended lip portion and thus the housing to the outer slide member 606. In addition, the housing includes holes for pins for a latch receiver and a lever arm as discussed, for example, with respect to FIGS. 1, 2, 3 and 4.

Figure 7:
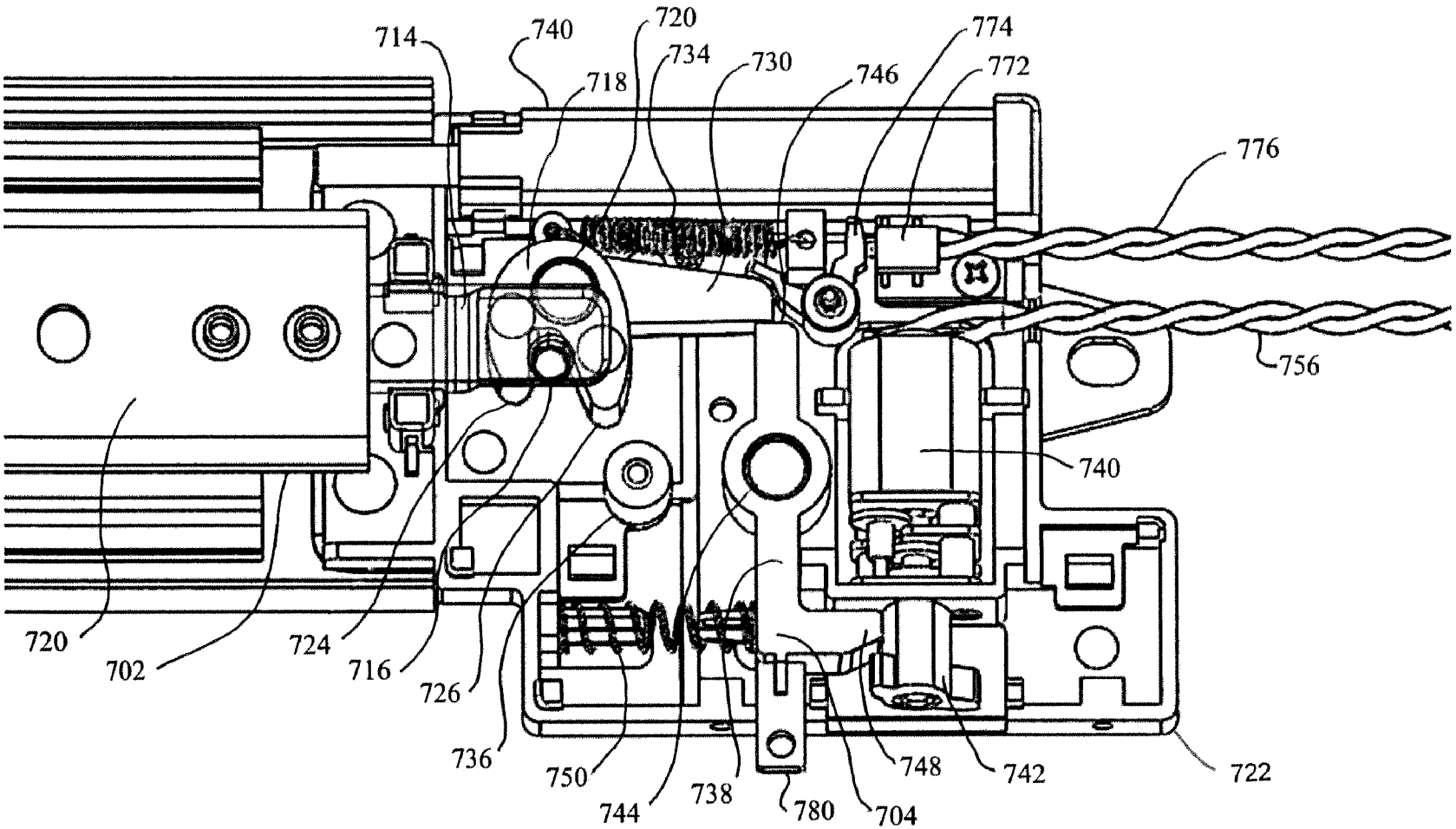
FIG. 7 illustrates another drawer slide with a lock mechanism in accordance with aspects of the invention.

FIG. 7 illustrates another drawer slide with a lock mechanism in accordance with aspects of the invention. The lock mechanism includes a latch receiver 718 rotatably mounted using a screw or rivet 720 to a housing base 722. Alternately, in some embodiments the latch receiver may be mounted to an outer slide member or a cabinet frame. The latch receiver and the lock mechanism are thin for use in an operating envelope (drawer to cabinet spacing) of the drawer slide. The latch receiver is generally U-shaped with for example, two legs extending to form a basin. As shown in FIG. 7, a first leg 724 and a second leg 726, define a basin therebetween for receiving a pin 716. A third leg 730, which also may be termed a tail, extends from one side of the of the generally U-shaped latch receiver approximately perpendicular to the first and second legs.

The pin 716 extends perpendicularly from an extension 714 attached to a rear position of a web 720 of an inner slide member 702 of the drawer slide. The extension may be cast metal and attached by rivets to the inner slide member. FIG. 7 illustrates the drawer slide and lock mechanism in a closed and locking position. The first and second legs of the latch receiver are rotated approximately perpendicular to direction of travel of the drawer slide, and the pin is captured within the basin between the first and second legs. While in this position, the first leg of the generally U-shaped latch receiver prevents forward movement of the pin, and therefore prevents forward movement of the inner slide member and drawer. The latch receiver is biased by a first spring 734 away from the closed position to an open position. The first spring is coupled to the latch receiver at a position approximately on the opposite side of the latch receiver relative to the basin. The first spring is coupled at its other end to the housing base via a stanchion or post extending therefrom to provide a counteraction to create a spring force when the latch receiver is rotated to the closed position, with the first spring therefore biasing the latch receiver to rotate to the open position.

A lever arm 738 maintains the latch receiver in the closed position. The lever arm is substantially flat and generally of rectangular shape. A hole 744 is defined on the lever arm at approximately midway of the length of the lever arm for insertion of a pin or rivet for mounting to the housing base. The pin or rivet provides a fulcrum for the lever arm to pivot about. Engagement between a top edge 746 of the lever arm and the bottom edge of the third leg prevents the latch receiver from rotating to the open position, thus locking the pin, the inner slide member, and the drawer in a closed position. The lever arm is biased to a locking position shown in FIG. 7, with the top edge of the lever arm in the travel path of the third leg of the latch receiver, by a second spring 750.

The lock mechanism also includes a drive assembly that is used to release the pin from the latch receiver upon activation of the drive assembly. The drive assembly components include a motor 740 and a motor cam 742.

When in the locking position, the second spring also biases a cam follower 748 formed at an end of the lever arm opposite the top edge against the motor cam. In one embodiment, the surface of motor cam is designed such that operation of the motor in a first direction rotates the motor cam to a camming position, pushing on the surface of the cam follower an amount sufficient to rotate the lever arm out of the travel path of the third leg. The latch receiver then rotates due to the first spring to the open position. Operation of the motor in a second, opposite, direction rotates the motor cam back to an uncammed position. In addition, in some embodiments, and as illustrated in FIG. 7, the motor cam includes a camming stop and an uncammed stop, both in the form of arms extending from the motor cam. The stops serve to prevent over rotation of the cam, in the cammed and uncammed positions, respectively.

The motor 740 is powered via motor wiring 756. Power may be supplied to the motor by or through batteries, or power outlets commonly found in residential or commercial settings, with the power supplied by a utility or back-up generator or the like. The motor may be any reversible motor with sufficient torque capability to overcome spring or other forces to rotate the lever arm when desired. For example, the motor may be a gear motor, stepper motor and the like.

Generally, the motor is activated when desired with the use of a button, switch, or similar device. In some embodiments drive circuitry for the motor may be provided, which may be activated by entry of a password or identification number by way of a keypad, by a signal, preferably encoded, from a wireless transmitter, or by some other way of receipt of a signal, preferably coded, indicating authorized opening of the drawer is requested.

The lock mechanism may include a sensor to signal whether the latch receiver is in the closed position. The sensor uses a switch 772 to provide an electrical indication that the latch receiver is closed. The switch may be a snap-action switch. The switch is coupled via sensor wiring 776, for example, to an indicator device or an alarm. A sensor activator 774 is used in the embodiment of FIG. 7 to couple the latch receiver to the switch. The sensor activator is generally L-shaped and is mounted to the housing base with a pivot point near the corner of the L-shape. When the latch receiver is in the closed position, the third leg of the latch receiver moves one leg of the sensor activator causing the other leg of the sensor activator to contact the switch and thereby signal the closed position of the latch receiver.

The lock mechanism may include a manual release 780. The manual release extends from the end of the lever arm near the cam follower. By moving the manual release in a direction away from the motor cam, the lever arm is moved to the unlocking position and the latch receiver may move to the open position. The manual release may be used, for example, in the event of a power outage disabling the motor.

Figure 8:
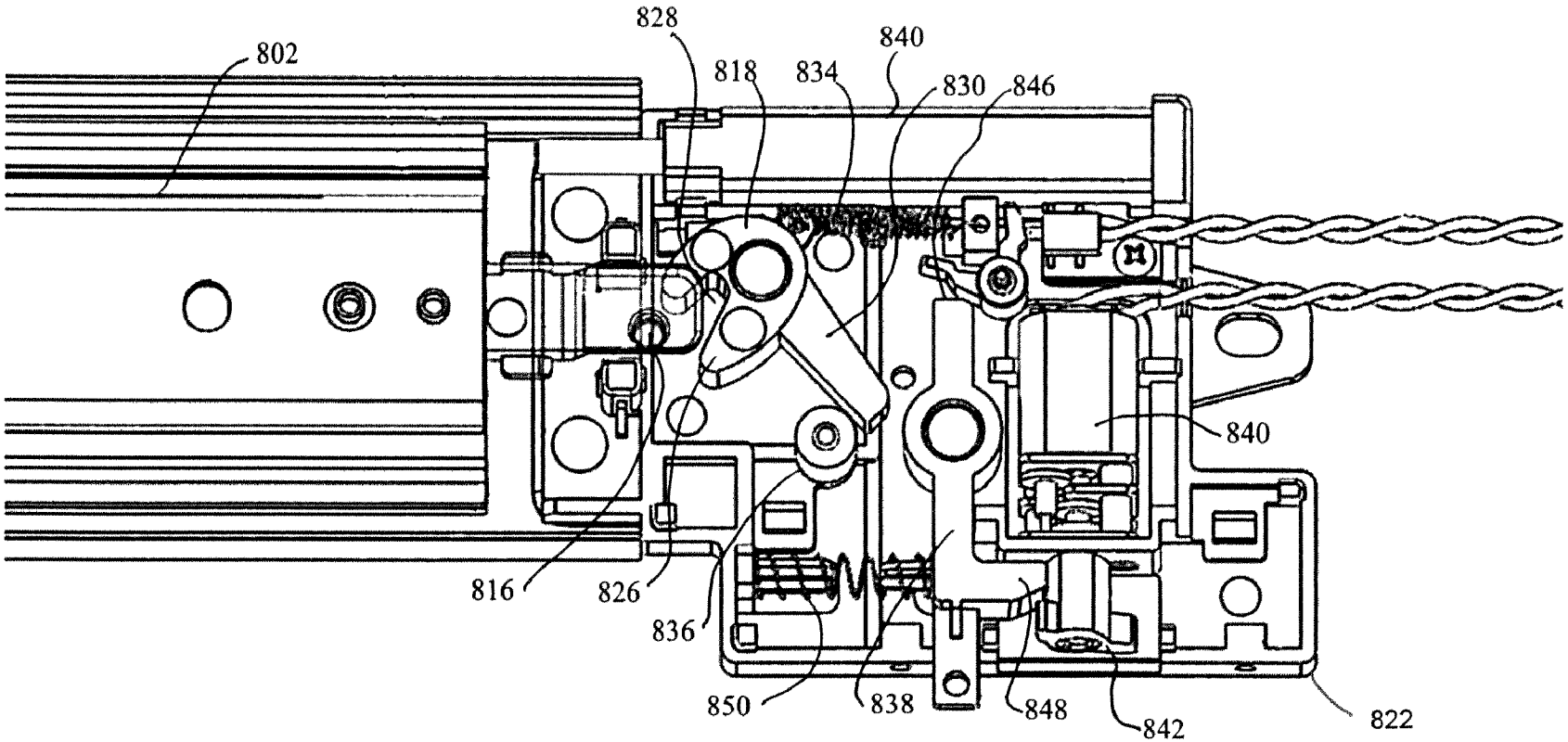
FIG. 8 shows operation of the device of FIG. 7.

FIG. 8 is an illustration of the device of FIG. 7 in an open position. In the open position, the opening of the basin 828 of the latch receiver 818 faces towards a "front" end of the lock mechanism. In this position, the pin 816 is allowed to move in or out of the basin, thus permitting forward movement or extension of the inner slide member 802, and therefore opening of the drawer coupled to the inner slide member.

The open position is reached by activation of the motor 840 to rotate the motor cam 842. Engagement between the surface of the motor cam and the surface of the cam follower 848 of the lever arm is done with sufficient force to overcome the bias of the second spring 850 and any friction between the top edge 846 of the lever arm 838 and the bottom edge of the third leg 830 of the latch receiver to rotate the lever arm about its pivot point. The rotation of the lever arm moves the top edge of the lever arm out of the travel path of the third leg of the latch receiver. With the third leg free from contact with the lever arm, the first spring 834 biases the latch receiver to the open position, swinging the third leg along its travel path until the third leg engages with a bumper 836 to stop the rotation. Preferably the bumper includes a soft compliant shell, for example of rubber, to reduce noise generated by contact of the third leg and the bumper. The bumper is positioned such that its engagement with the third leg counters the bias from the first spring to cause the latch receiver to stop rotating with the basin positioned to receive the pin. The constant biasing of the latch receiver by the first spring and the counteraction of this bias by the third leg against the bumper ensures that the latch receiver is held in place.

When latch receiver moves to the open position, forward movement of the pin is assisted by a compression spring (not shown) in a housing 822. The compression spring has an end coupled to a plunger, which, in one embodiment, bears against an intermediate slide member of the drawer slide assembly. When the drawer slide is closed, the intermediate slide member, via the shaft, compresses the compression spring. Once the latch receiver releases the pin, the compression spring provides an open-assist force pushing the intermediate slide member, and therefore the inner slide member and drawer, towards an open position.

In the open position, the latch receiver is positioned in the travel path of the pin, and the basin of the latch receiver is positioned for receiving the pin. To close the drawer slide and lock the lock mechanism, for example, when access to the contents of the drawer is complete, a user may close the drawer, closing the drawer slide, causing the inner slide member to move toward the lock mechanism. As the inner slide member is moved towards the closed position, the pin reaches the basin of the latch receiver. When the pin engages the latch receiver, movement of the pin against the second leg 826 of the latch receiver overcomes the first spring bias to rotate the latch receiver to a closed position.

Rotation of the latch receiver causes the third leg of the latch receiver to also rotate away from the bumper. As shown in FIG. 8, the lever arm is in the travel path of the third leg of the latch receiver. Accordingly, the third leg of the latch receiver contacts or bumps the lever arm while rotating. However, the rotational force provided by the pin against the second leg of the latch receiver is sufficient to overcome the spring force provided by the second spring engaged with and holding the lever arm in its locking position relative to the latch receiver. A top end of the lever arm is therefore pushed out of the way by the third leg and made to rotate about the pivot point. The rotation of a bottom end of the lever arm causes the second spring to be compressed.

As shown in FIG. 8, however, due to the bias created by the compressed second spring against the bottom end of the lever arm, the lever arm returns to the locking position after the third leg has cleared the top edge of the lever arm. Engagement between the top edge of the lever arm and the bottom edge of the third leg prevents the latch receiver from rotating back to the open position, thus locking the pin, the inner slide member, and the drawer in a closed position.

Figure 9:
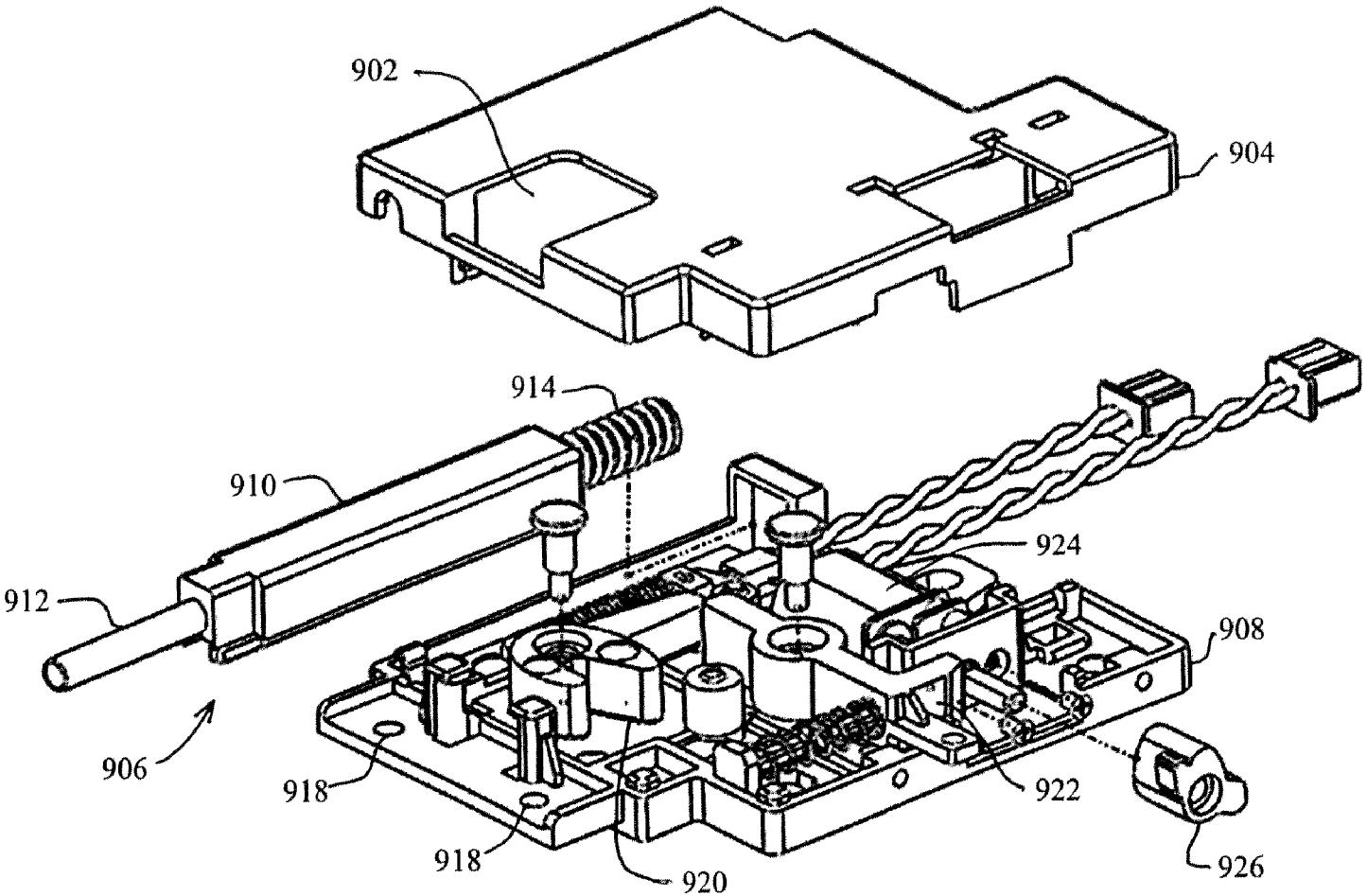
FIG. 9 illustrates a semi-exploded view of another assembly including a lock mechanism in accordance with aspects of the invention.

FIG. 9 is a semi-exploded view of an assembly including a lock mechanism in accordance with an embodiment of the present invention. A housing includes a cover 904 and a base 908, and the housing may, for example, be used to house the lock mechanisms of FIGS. 7 and 8. The housing is configured for mounting to a drawer slide member or cabinet, for example using mounting holes 918. The cover includes an open slot 902. As illustrated in FIG. 9, the open slot is about a forward edge of the cover, and the open slot provides access to the inner components of the lock mechanism to facilitate engagement therewith. When the inner slide member approaches the lock mechanism so as to be in the closed position, an extension of an inner slide member is received into the open slot. A latch receiver 920 disposed below the cover and about the open slot is configured to capture a pin on the inner slide member, such that the pin, and therefore the inner slide member, is prevented from moving to an open position.

In the embodiment of FIG. 9, the lock mechanism includes the latch receiver, a lever arm 922 for locking the latch receiver in a closed or locked position, and a motor 924 and cam 926 for rotating the lever arm so as to release the latch receiver.

An automated open-assist mechanism 906 is provided within the housing to provide an open-assist feature for the drawer slide and drawer. In one embodiment, the open-assist mechanism is positioned in the housing so as to engage a portion of a drawer slide assembly, for example an intermediate slide member. The open-assist mechanism includes a spring housing 910 which incorporates a plunger 912 coupled to a biasing member 914, such as a spring. Operationally, in one embodiment, upon closing of the drawer slides, the plunger is contacted by the intermediate slide member, which causes the plunger to compresses the biasing member within the housing. The biasing member therefore biases the intermediate slide member forward while the inner slide member is locked in position. When the latch receiver moves to the unlocked position, however, the bias provided by the biasing member pushes the intermediate slide member via the plunger, forward, carrying the inner slide member and drawer forward to at least a slightly open position.

Figure 10:
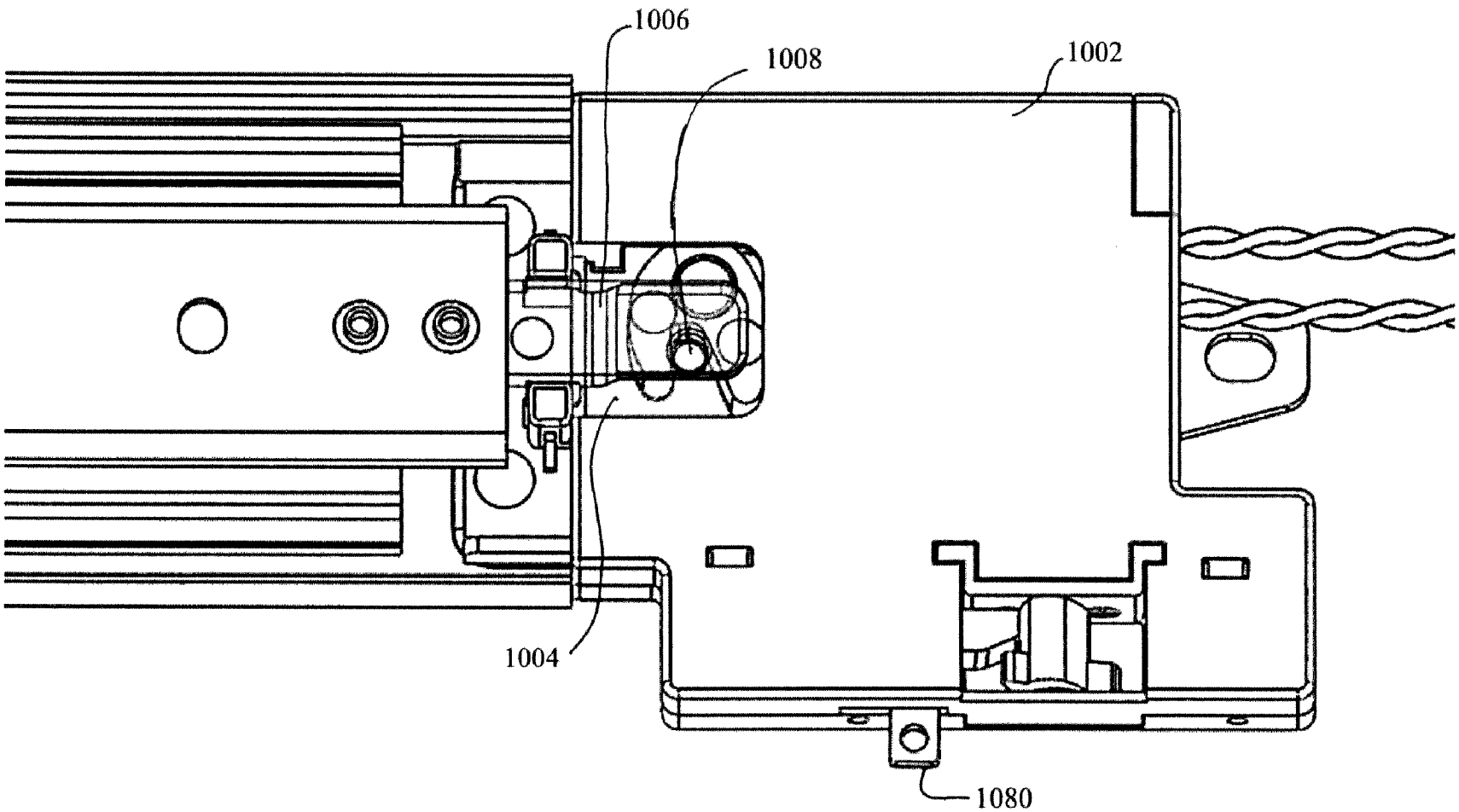
FIG. 10 is the front view of another housing for a lock mechanism coupled to a drawer slide assembly in accordance with aspects of the invention.

FIG. 10 is a view including a front of a housing for a lock mechanism coupled to a drawer slide assembly. As illustrated, the drawer slide assembly is in the closed and locking position. In this embodiment, a top cover 1002 includes an open slot 1004 to receive an extension 1006 of an inner slide member. The extension carries a pin 1008 which engages a latch receiver positioned below the top cover and within an outline defined by the open slot. A manual release 1080 extends from a lower edge of the housing.

Figure 11:
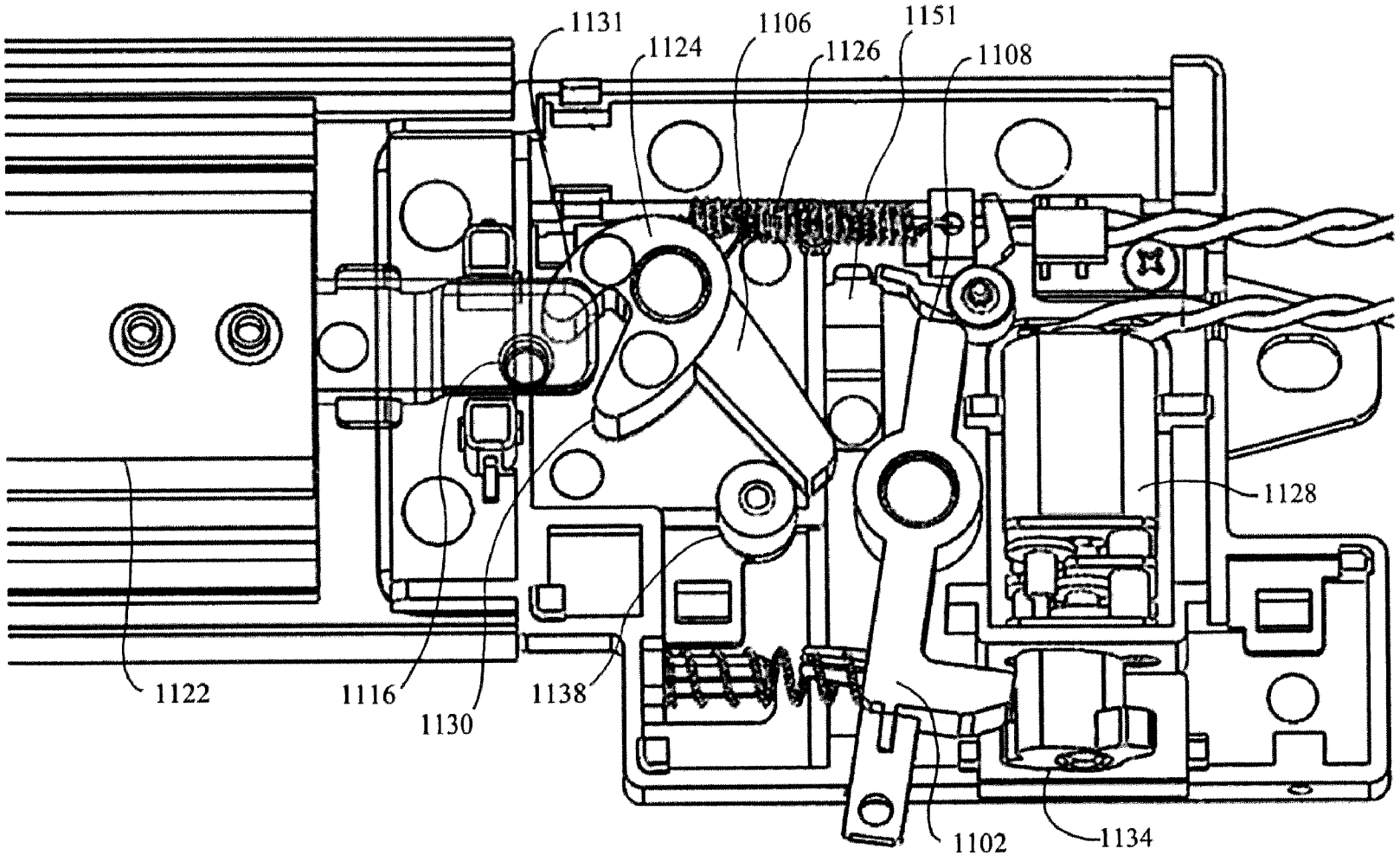
FIG. 11 illustrates another drawer slide with a lock mechanism in accordance with aspects of the invention.

FIG. 11 illustrates another lock mechanism in accordance with aspects of the invention. The lock mechanism generally includes the components of the lock mechanism of FIG. 7. In the device of FIG. 11, however, a detent 1151 is included to hold a latch receiver 1124 in a closed position. The detent retains a third leg 1106 of the latch receiver.

The lock mechanism is illustrated in FIG. 11 in an open and unlocking position. From a closed and locking position, opening the lock mechanism begins by activating a motor 1128 to rotate a cam 1134 to move a lever arm 1102 from a locking position to an unlocking position. When the lever arm is in the locking position, a top edge 1108 of the lever arm blocks movement of the third leg of the latch receiver. When the lever arm is in the unlocking position, the top edge of the lever arm is moved to the position shown in FIG. 11 where the lever arm does not block movement of the third leg of the latch receiver. The lock mechanism of FIG. 11 does not include an open-assist mechanism, thus the detent restrains movement of the third leg of the latch receiver to keep the receiver in the closed position until a sufficient force is applied to move the third leg past the detent. The force may by applied by a person pulling on a drawer attached to an inner slide member 1122 coupled to a pin 1116. The pin pushes on a first leg 1131 of the latch receiver and rotates the latch receiver to move the third leg of the latch receiver past the detent. After the third leg of the latch receiver clears the detent, the latch receiver rotates by the force of a first spring 1126 until the third leg of the latch receiver is blocked in the open position by a bumper 1138.

Closing the lock mechanism essentially a reverses the opening sequence. For example, when access to the contents of the drawer is complete, a user may close the drawer, causing the inner slide member to move toward the lock mechanism. The pin extending from a rear position of the inner slide member will contact a second leg 1130 of the latch receiver. Although the latch receiver is biased by the first spring 1126 to an open position, movement of the pin against the second leg will overcome the first spring bias to rotate the latch receiver to a closed position. When the lever arm is in the unlocking position, the detent will maintain the latch receiver in the closed position. When the lever arm is in the locking position, the top of the lever arm will retain the latch receiver in the closed position and lock the drawer.

Figure 12:
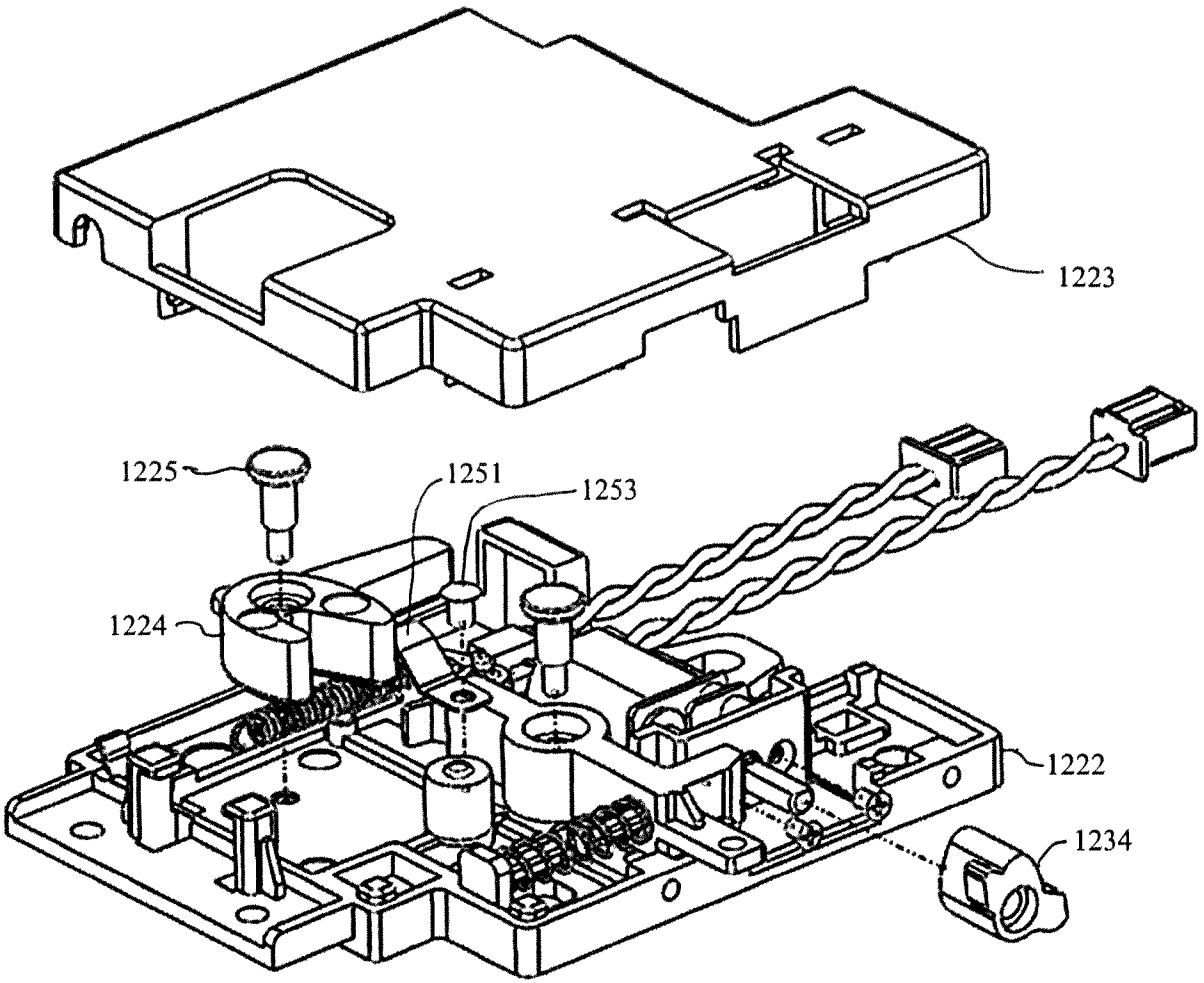
FIG. 12 illustrates a semi-exploded view of another assembly including a lock mechanism in accordance with aspects of the invention.

FIG. 12 is a semi-exploded view of the lock mechanism of FIG. 11. The detent 1251 is illustrated above its location on the housing base 1222. A rivet 1253 or other fastener is used to attach the detent to the housing base. The latch receiver 1224 is also illustrated above its location on the housing base and a rivet 1225 or other fastener is used to attach the latch receiver to the housing base. In some embodiments, a cover 1223 mates to the housing base to enclose components of the lock mechanism.

Figure 13:
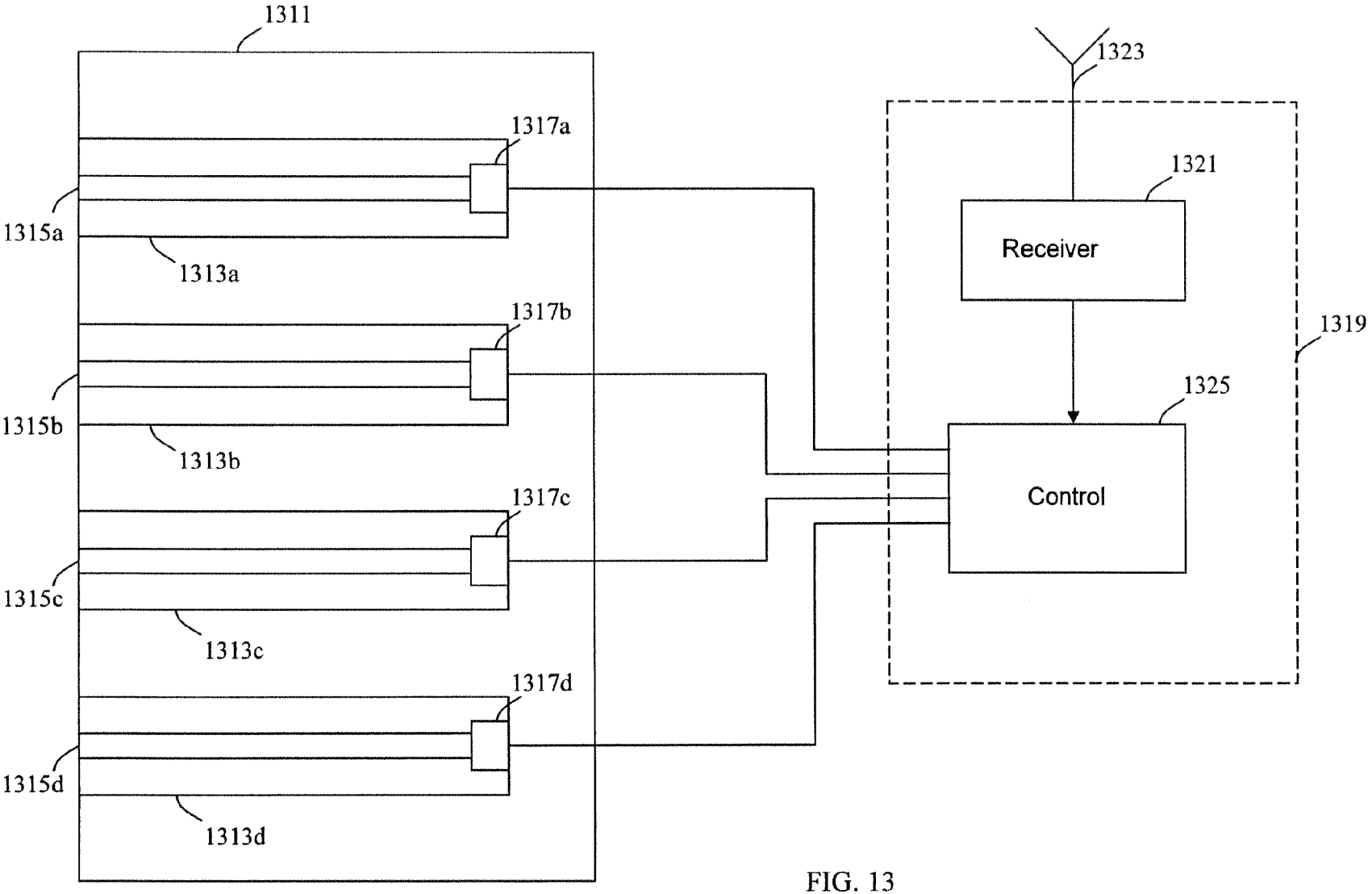
FIG. 13 is a semi-block diagram of a system in accordance with aspects of the invention.

FIG. 13 is a semi-block diagram of a system in accordance with aspects of the invention. As illustrated in FIG. 13, a cabinet 1311 has a plurality of drawers, with four drawers 1313*a-d* shown. Each of the drawers is extensibly coupled to the cabinet by a drawer slides. The drawer slides may be in the form of an undermount drawer slide, for example mounted underneath a drawer, or telescopic or other type of drawer slide, for example mounted to opposing sides of a drawer. In the example of FIG. 13 each drawer is coupled to the cabinet using a pair of telescopic drawer slides, with one telescopic drawer slide 1315*a-d* shown for each drawer.

Each of the drawer slides 1315*a-d* includes a corresponding lock mechanism 1317*a-d*, with each lock mechanism shown about the rear of a corresponding drawer slide. In some embodiments multiple or all drawer slides for a particular drawer may be equipped with a lock mechanism, in other embodiments only a single drawer slide may be equipped with a lock mechanism. The lock mechanism may be, for example, as discussed with respect to FIGS. 1 and 2, or as discussed with respect to other figures herein. In most embodiments the locking mechanism mechanically latches drawers in the closed position, generally by restricting movement of a drawer slide member with respect to the cabinet, and through electronically driven actuation releases the drawer slide member to allow movement with respect to the cabinet. In addition, in many embodiments one or more, or all, drawer slides are also provided a push out device, for example a spring driven push out device, to at least partially open a drawer upon release of the drawer slide member.

Each of the lock mechanisms is electrically coupled to control circuitry 1325. The control circuitry may be contained within a housing 1319, which may be within or coupled to the cabinet. In some embodiments common control circuitry is provided for all of the drawers, for example with separate electrical connections to lock mechanisms of each drawer. In other embodiments separate control circuitry may be provided for each drawer, and the separate control circuitry may be contained within separate housings. The control circuitry includes circuitry for generating a release signal, for example on a drawer-by drawer basis. In most embodiments the control circuitry receives an input signal and, based on the input signal, determines if the release signal should be generated. In many embodiments the control circuitry generates the release signal for a particular drawer if the input signal matches a defined pattern for the particular drawer. As an example, the control circuitry may be configured in some embodiments to generate a release signal for a first drawer if the control circuitry determines that a received input signal matches a code set for the first drawer, to generate a release signal for the second drawer if the control circuitry determines that a received input signal matches a code set for the second drawer, and so on.

In the embodiment shown in FIG. 13 the control circuitry receives the input signal from a receiver 1321 which is configured to receive wireless communications, for example by way of an antenna 1323, although infrared or other wireless communications means may be used in other embodiments. In some embodiments, the control circuitry may receive the input signals by way of a radio frequency identification (RFID) card reader or proximity sensor. In still other embodiments the control circuitry may receive the input signals by way of a touchpad, for example a numeric touchpad for entering codes, or other hardwired input circuitry. The receiver may be located in the same housing as the control circuitry, or, for example as may occur more often occur with use of a touchpad, external to the housing.

The control circuitry and the receiver are powered by AC utility power or generator power in some embodiments, generally converted to DC power by power conversion circuitry, which may be provided by a power supply unit. In other embodiments the control circuitry and receiver are powered by battery power. In some embodiments AC utility power or generator power may be a primary source of power, with battery power provided as a backup source of power in the event of failure of the primary source of power.

Figure 14:
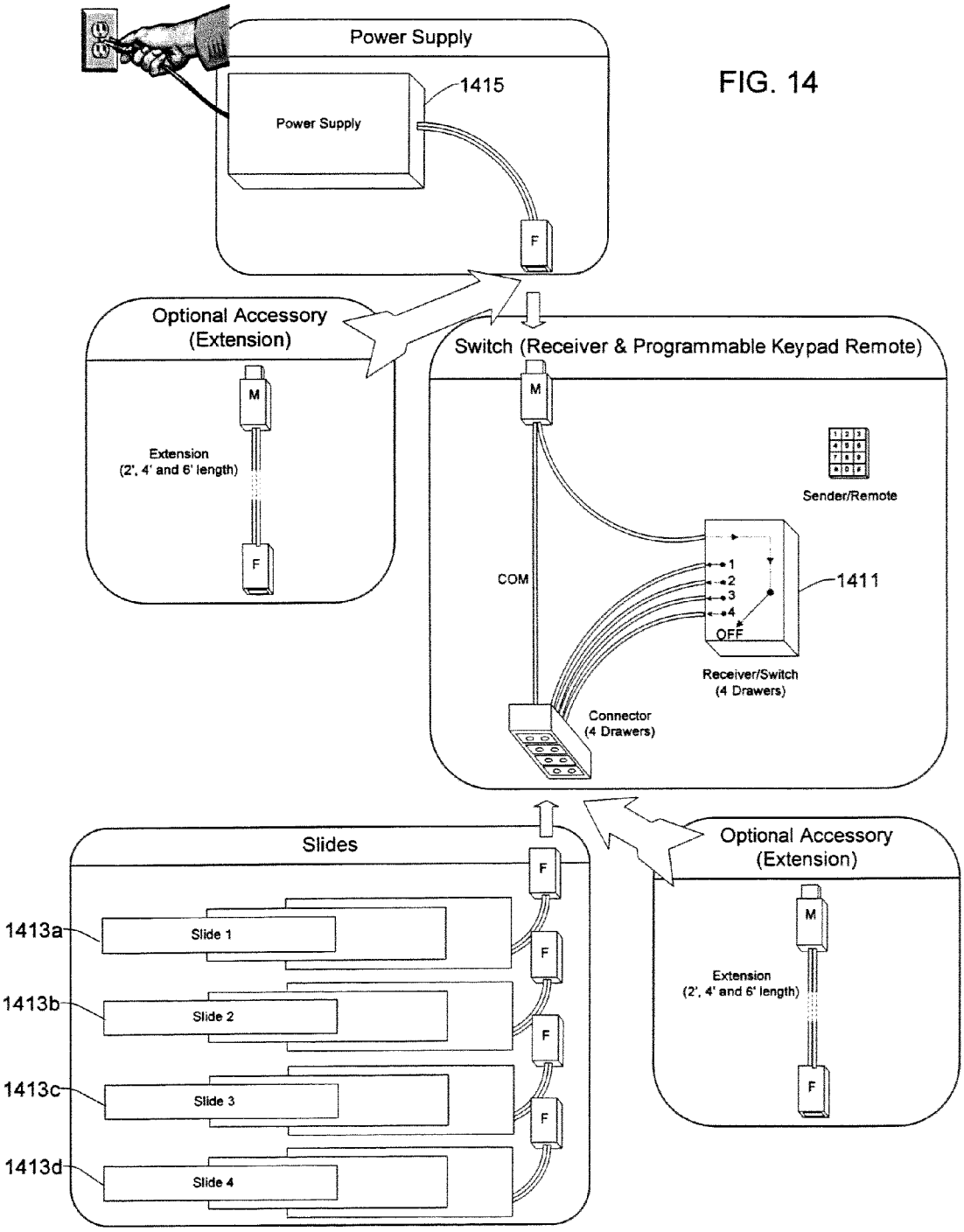
FIG. 14 is a block diagram of a system in accordance with aspects of the invention.

FIG. 14 is a further block diagram of a system in accordance with aspects of the invention. In the system of FIG. 14 a receiver and control circuitry 1411 is configured to generate release signals for lock mechanisms (not shown) for a plurality of drawer slides 1413*a-d*. The embodiment of FIG. 14 includes four drawer slides. Other embodiments may have other numbers of drawer slides. The drawer slides extensibly couple drawers to a cabinet, and the lock mechanisms may be as previously discussed. In the embodiment of FIG. 14 power is provided to the receiver and control circuitry by way of a power supply 1415 coupled to utility power. The control circuitry is configured to switchably provide a release signal to a drawer based on a signal received by the receiver from a remote transmitter. The signal from the remote transmitter may be in the form of a code, with different codes used for different drawers.

Figure 15:
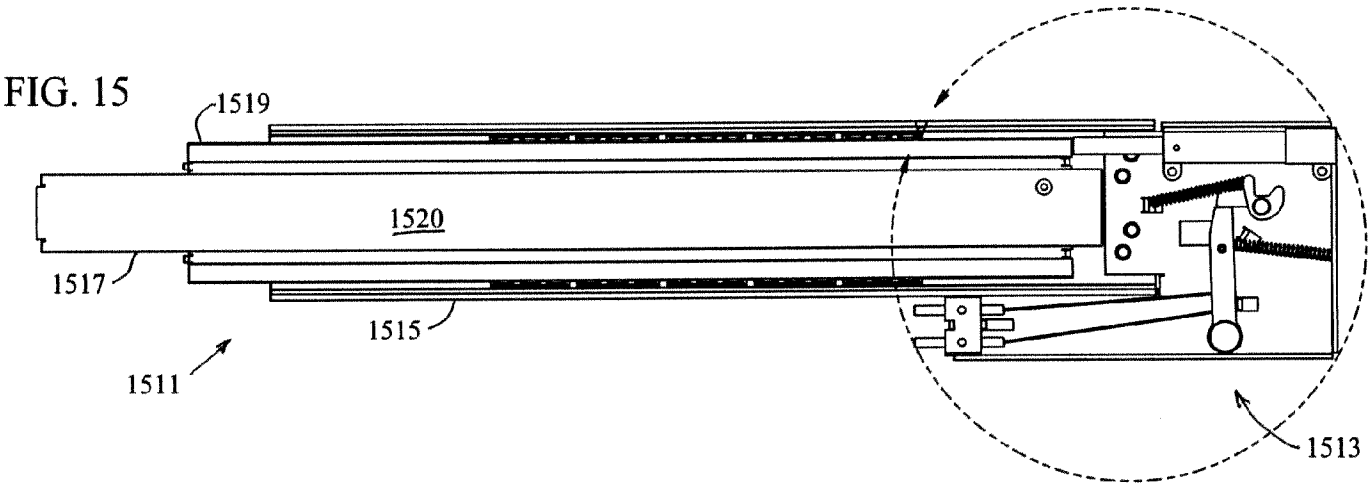
FIG. 15 illustrates a drawer slide with a lock mechanism in accordance with aspects of the invention.

FIG. 15 illustrates a drawer slide 1511 with a lock mechanism 1513. The lock mechanism is comparable in thickness to the drawer slide. In some embodiments, the thickness of the lock mechanism is less than ½ inch. A latch arm is on a drawer slide coupled to and moving with a drawer, and a latch receiver is coupled to a drawer slide coupled to and maintaining position of a cabinet. The latch receiver receives the latch arm when the drawer slide is in or approximate a closed position. The latch receiver is maintained in a locking position by a lever arm, which is moveable to an unlocking position by contraction of a wire formed of a shape memory alloy. Contraction of the wire may be provided, for example, by passing a current through the wire.

In some embodiments the latch receiver is maintained in the locking position by a top of the lever arm. In some embodiments the latch receiver is biased towards an open or unlocked position by a spring, and movement of the lever arm to the unlocking position, for example by contraction of the wire, releases the latch receiver to the unlocking position. In some embodiments contraction of the wire is momentary, and the lever arm is biased to the locking position by a spring. In some embodiments the latch arm moves the latch receiver to the locking position when the drawer is closed.

As illustrated in the embodiment of FIG. 15, the drawer slide is a three member telescopic drawer slide, with an outer member 1515 configured for mounting to a cabinet, an inner member 1517 configured for mounting to a drawer, and an intermediate member 1519 coupled between the outer member and the inner member. Each of the three slide members include a longitudinal web (with for example the longitudinal web of the inner slide member identified by reference numeral 1520) with bearing raceways along the length of the web. In various embodiments, greater or fewer numbers of slide members are used, and in various embodiments different types of drawer slide members may be used, for example over and under slides, undermount slides, friction slides, or other types of slides.

The three drawer slide members, which are coupled by way of ball bearings in many embodiments, are arranged with the intermediate member nested within the outer member, and the inner member in turn nested within the intermediate member. When mounted to a cabinet and a drawer, with the slide is in the closed position the intermediate and inner slide members are substantially within the volume of the outer slide member.

Figure 16:
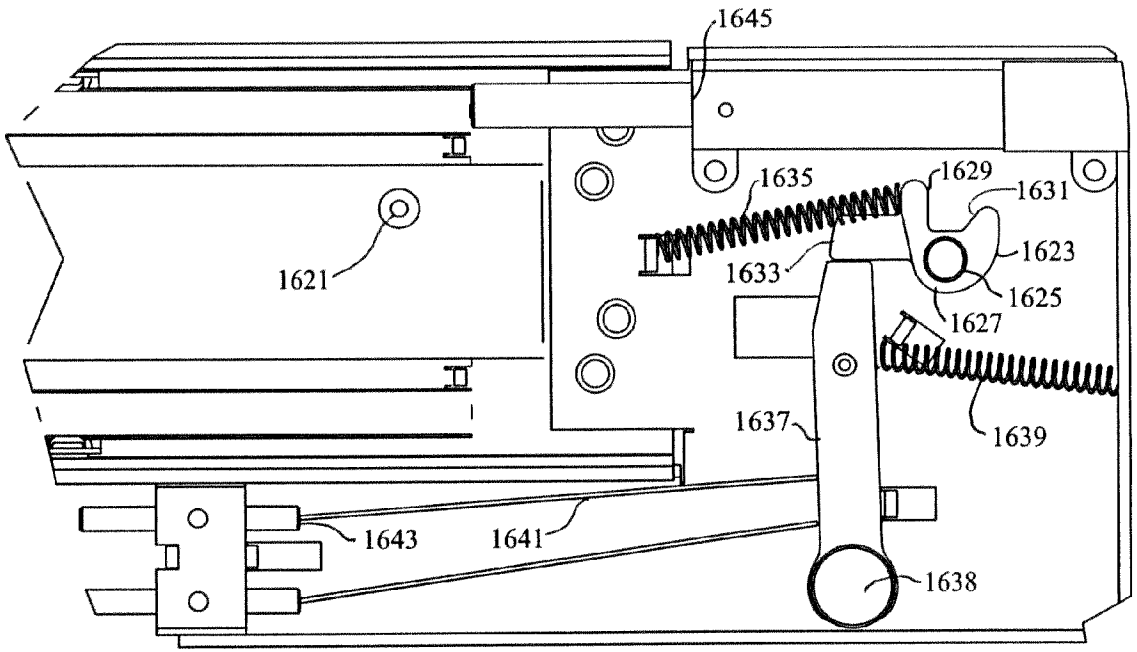
FIG. 16 illustrates a magnified view of the portions of FIG. 15.

As shown in FIG. 16, the inner member carries a pin 1621 towards its rear end. As shown, the pin extends from the web of the inner member and towards the web of the intermediate member. As the inner member approaches the closed position, the pin is received by a latch receiver 1623, for example coupled to the outer slide member. For the latch receiver of FIG. 16, the pin contacts and rotates the latch receiver, with the latch receiver shown already in FIG. 16 in the locked or closed or latched position for convenience. With the pin received by the latch receiver, the pin, and therefore the inner slide member is prevented from moving to an open position. Thus, the pin may be considered a latch arm, and the pin and the latch receiver may together be considered a latch.

The pin may be welded or otherwise attached to the web of the inner member, for example as by riveting with the pin being a rivet. In other embodiments the pin may be formed of the material of the inner slide member, and may for example be in the form of a bayonet or other form punched or pressed from the material of the inner slide member.

In the embodiment of FIG. 16, the latch receiver is somewhat U-shaped, with a rivet 1625 coupling a base 1627 of the latch receiver to the outer slide member, or other item coupled to the cabinet. Two legs extend from the body, a forward leg 1629 and a rear leg 1631, with the two legs forming a basin for receiving the pin. A tail 1633 extends from one side of the of the somewhat U-shaped latch receiver. In the open or unlocked position the opening of the basin faces towards a front of the cabinet, releasing the pin and allowing forward movement or extension of the inner slide member, and therefore opening of a drawer coupled to the inner slide member. In the closed or locked position the opening of the basin is approximately perpendicular to direction of travel of the drawer slides. With the pin in the basin, therefore, the forward leg of the somewhat U-shaped latch receiver prevents forward movement of the pin, and therefore the drawer slide.

The latch receiver is biased to the open or unlocked position by a spring 1635. In the embodiment of FIG. 16 the spring is coupled to the forward leg and to the outer slide member at a position forward of the latch receiver. Counteracting the spring force, as shown in FIG. 16, is a lever arm 1637, which maintains the latch receiver in a closed or locked position. A top of the lever arm prevents rotation of the latch receiver to the open position, through contact with the tail of the latch receiver as shown in FIG. 16. Rotation of the lever arm about its fulcrum 1638 allows the tail of the latch receiver to clear the top of the lever arm, allowing the spring of the latch receiver to rotate the latch receiver to the open or unlocked position.

The lever arm is biased to the locking position, with the top of the lever arm in the travel path of the tail of the latch receiver, by a spring 1639. The lever arm is rotated to the open position, with the top of the lever arm away from the tail of the receiver, by a wire 1641. The wire, as shown in FIG. 16, is coupled to a point along the length of the lever arm, and the wire stretches largely parallel and within a plane defined by the slide members to a connection 1643. Activation of the wire overcomes the spring force provided by the spring of the lever arm, and rotates the lever arm such that the tail of the latch receiver clears the top of the lever arm.

The wire is formed of a shape memory alloy. Shape memory alloys generally change shape upon heating and cooling, and are marketed, for example, by Dynalloy. Inc. of Costa Mesa, Calif., under the name FLEXINOL™. In most instances the shape memory alloy contracts upon heating, often provided by resistive heating upon passing a current through the wire, and the shape memory alloy expands upon subsequent cooling, which may be provided by merely removing the applied current and allowing ambient surrounding air to cool the alloy. A shape memory alloy in the form of a wire is often beneficial, the wire has a relatively large surface area for its length, allowing for reduced time in cooling and consequent expansion of the wire.

Activation of the wire in FIG. 16 is provided by heating the shape memory alloy wire of FIG. 16 by passing a current through the shape memory alloy wire. The current in FIG. 16 is introduced through a contact to which one end of the wire is coupled, with the other end of the wire coupled at the position along the length of the lever arm. Placing the wire closer to the fulcrum of the lever arm allows for increased distance of movement of the top of the lever arm for a given contraction of the wire.

In some embodiments power to provide the current is provided by a battery, with drive circuitry controlling application of the current. The battery may be, for example, a 1.5 volt battery or other suitable battery. The drive circuitry may include circuitry such as voltage or current regulation circuitry and circuitry to determine when to apply power to the wire, or may be accompanied or coupled to such circuitry.

In other embodiments power may be supplied by or through power outlets commonly found in residential or commercial settings, with the power supplied by a utility or back-up generator or the like. A transformer may be used to convert AC supplied power to DC, particularly for use with the drive circuitry, although in some embodiments AC power may be supplied to the wire.

Two wires are provide in the embodiment of FIG. 16. A first of the two wires may be used in normal operation. A second of the two wires may be used as a backup, for example in the event the first wire becomes damaged. Moreover, the second wire may be provided an alternative energy source, for example a battery, and possibly alternative operating circuitry, for example in the event of a power failure of a primary energy source or damage to primary operating circuitry. The use of the second wire as a back-up, and in some embodiments alternative drive circuitry, is beneficial in that operation of the locking mechanism may continue to be provided, at least temporarily, in the event of component or power failure, without, for example, requiring service by a technician to restore operation of the device.

In some embodiments drive circuitry for the wire is provided by circuitry activated by entry of a password or identification number by way of a keypad, by a signal, preferably encoded, from a wireless transmitter, or by some other way of receipt of a signal, preferably coded, indicating authorized opening of the drawer is requested.

Upon or after receiving the coded signal, the drive circuit passes current through the wire, with the current for example passing to ground through the lever arm or by way of a return wire. The wire contracts due to resistive heating, and pulls the lever arm out of the travel path of the tail of the latch receiver. The spring of the latch receiver biases the latch receiver to the unlocking position, and the pin, and therefore the inner slide member and drawer, are free to move to a forward extended position.

A further spring may be provided to provide an automatic opening feature for the drawer slide and drawer. As shown in FIG. 16, a spring 1645 is mounted to a plate on which is mounted the locking mechanism, and to which the outer slide member is coupled. The spring is compressed by upon closing of the drawer slides, as illustrated by the intermediate slide member, although the inner slide member is used in some embodiments. The spring therefore biases the intermediate slide member forward. With the inner slide member locked in position the intermediate slide member is restrained by a stop (not shown) on the inner slide member, such as commonly found in drawer slides to provide proper closing operation, or some other slide sequencing feature. When the latch receiver moves to the unlocking position, however, the intermediate slide member is free to move forward, carrying the inner slide member and drawer forward to at least a slightly open position.

When access to the contents of the drawer is complete, a user may close the drawer, closing the slide, and forcing the pin against the rear leg of the somewhat U-shaped latch receiver, which is in the travel path of the pin. The force of the pin against the rear leg rotates the latch receiver from the open or unlocking position to the closed and locked position. In some embodiments the current activating the wire may then be removed, allowing the wire to expand and return the lever arm to the locking position. In most embodiments, however, current to the wire is removed relatively quickly, generally within seconds or milliseconds, and the wire cools, generally within seconds, and the lever arm returns to the locking position while the drawer is still open and the latch receiver is in the open position.

In the embodiment of FIG. 16, therefore, the lever arm is in the travel path of the tail of the latch receiver. The force of the pin against the second leg of the latch receiver, however, is sufficient to overcome the spring force provided by the spring of the lever arm, and the lever arm is therefore pushed out of the way by the tail of the latch receiver, with the lever arm returning to the locked position after the tail has cleared the lever arm.

Also in FIG. 16, the top of the lever arm is generally flat. As the lever arm is rotated from the locked to the unlocking position, the top of the lever arm and the side of the tail of the latch receiver define divergent lines (when viewed from the side) or non-parallel planes. The lever arm and the tail therefore contact substantially upon a single line substantially perpendicular to the direction of motion of the top of the lever arm, preferably reducing frictional contact between the lever arm and the tail, allowing for decreased force applied by contraction of the wire.

Figure 17D:
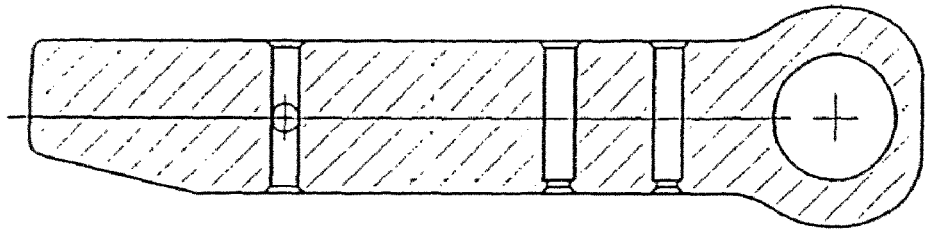
FIGS. 17A-D illustrate an embodiment of a lever arm in accordance with aspects of the invention.
Figure 17C:
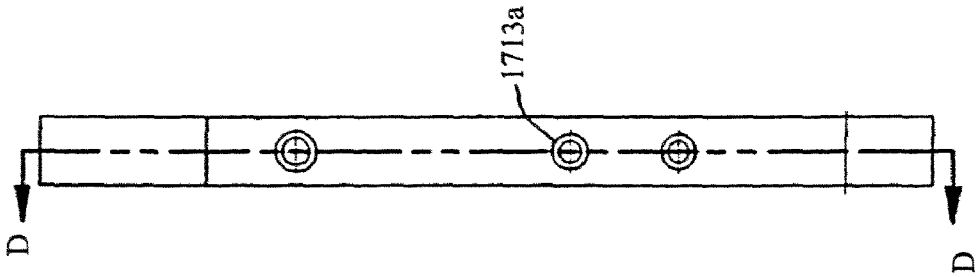
Figure 17B:
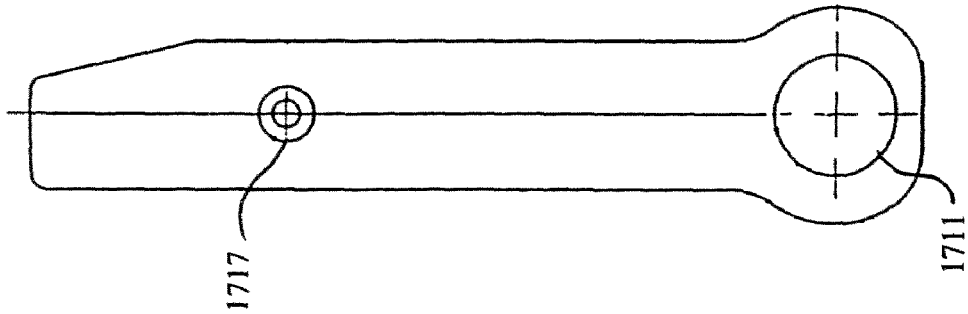
Figure 17A:
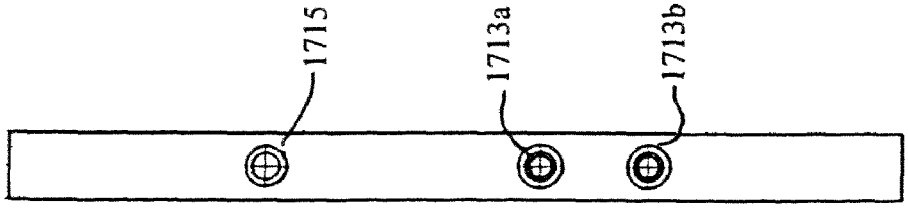

FIGS. 17A-D shows an embodiment of a lever arm in accordance with aspects of the invention. FIG. 17A is a side view of the lever arm; FIG. 17B is a front view of the lever arm; FIG. 17C is another side view of the lever arm; and FIG. 17D is a cross-section view along the line D-D shown in FIG. 17C. The lever arm is substantially flat and generally of rectangular shape. A hole 1711 is provided about one end, for insertion of a pin or rivet for mounting to a plate or the like, with the pin or rivet providing a fulcrum for the lever arm. Two through holes 1713*a*, 1713*b* perpendicular to the fulcrum hole are provided approximately one third of the distance along the length of the lever arm from the fulcrum hole. The through holes may each receive a wire of shape memory alloy. A further through hole 1715, also perpendicular to the fulcrum hole, is provided approximately two thirds the distance along the length of the lever arm from the fulcrum hole. The further through hole may receive a spring to bias the lever arm when installed. As shown in FIG. 17, a cross drilled hole 1717 is also provided through and perpendicular to the further hole. The cross drilled hole may be used, for example, to receive and secure an end of the spring, or for placement of a pin to accomplish the same.

Figure 18:
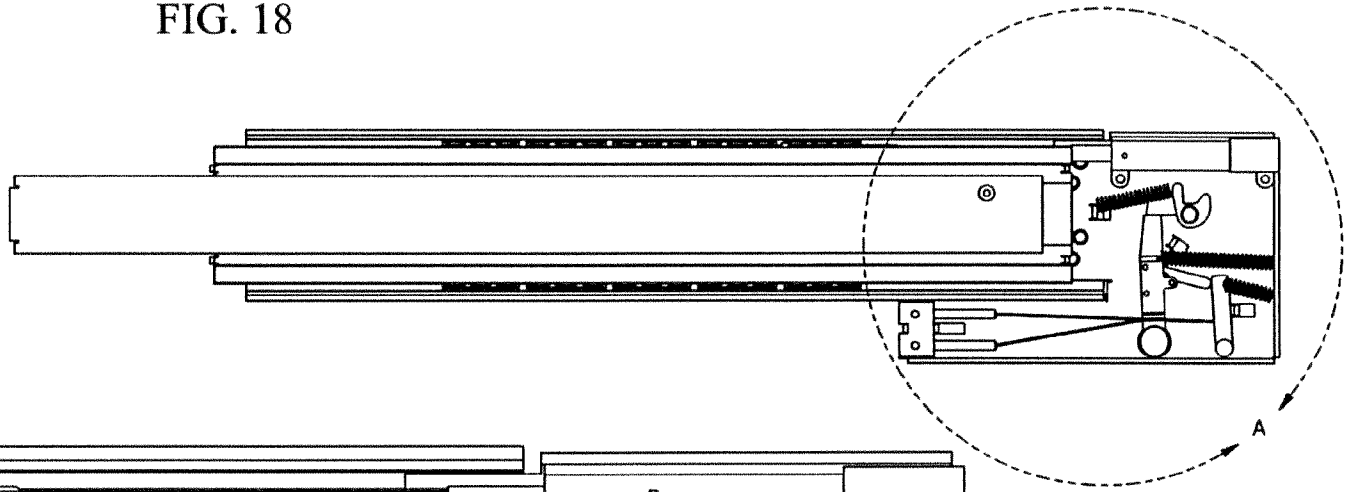
FIGS. 18, 18A, and 18B illustrate a further slide and locking mechanism in accordance with aspects of the invention.
Figure 18B:
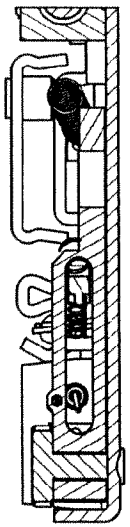
Figure 18A:
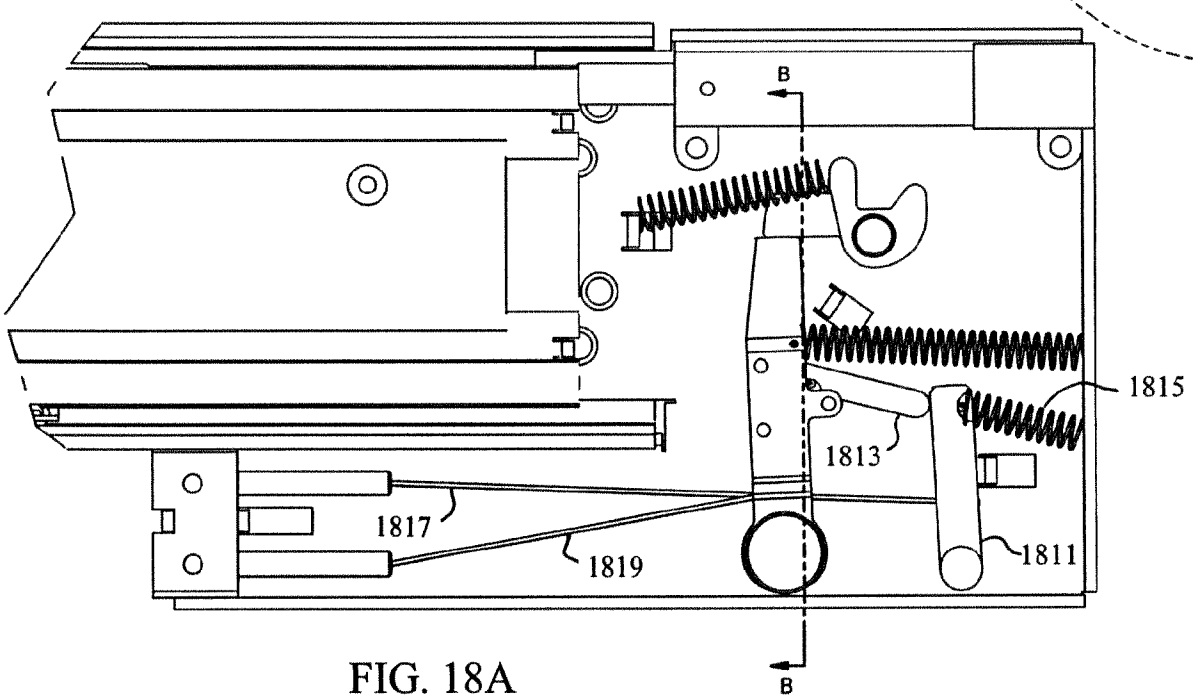

FIG. 18 illustrates a further slide and locking mechanism in accordance with aspects of the invention. FIG. 18A is a detail view of area A shown in FIG. 18: and FIG. 18B is a cross-section view along the line B-B shown in FIG. 18A. The slide and locking mechanism generally includes the components of the slide and locking mechanism of FIG. 15. In the device of FIG. 18, however, the shape memory alloy wire moves a second lever arm 1811, which by way of an interconnecting bar 1813 moves the lever arm.

As shown in FIG. 18A, the lever arm is between the connection for the SMA wire and the second lever arm. In the embodiment of FIG. 18, the SMA wire passes by or through the lever arm and is attached to the second lever arm. The second lever arm, like the lever arm, is biased by a spring 1815 to a locking position. Heating of the SMA wire contracts the SMA wire, and pulls a top of the second lever arm towards the lever arm.

The bar 1813 is coupled to the lever arm, and the bar is in contact with the second lever arm. As the second lever arm rotates about its fulcrum, the bar is displaced forward, and moves the lever arm to the unlocking position. Thus, the second lever arm in some respects acts as a cam, with the bar acting as a cam follower and moving the lever arm.

As shown in FIG. 18A, the bar is pivotably coupled to the lever arm, with the lever arm including a stop to prevent downward motion (as viewed in FIG. 18A) of the bar. As the second lever arm moves forward therefore, force applied to the bar by the second lever arm is transferred to the lever arm through contact of the bar and the stop.

Conveniently, in some embodiments the second lever arm is displaced by contraction of the wire a sufficient distance that the second lever arm clears the bar, allowing the lever arm to return to the locking position due to force applied by the spring coupled to the lever arm. The second lever arm may thereafter be returned to the locking position, after cooling and consequent expansion of the wire, by force of the spring coupled to the second lever arm, with the second lever arm momentarily displacing upward the pivotably connected bar, which may thereafter return to its normal position by way of gravity, or in some embodiments use of a spring. The lever arm may therefore be in position to provide locking functions substantially immediately after opening of the drawer without first requiring cooling and expansion of the wire.

In the embodiment of FIG. 18 two wires are used. A first wire 1817 of the wires is coupled to the second lever arm. The first wire may pass over or under the lever arm, or in some embodiments pass through the lever arm. A, second wire 1819 of the wires is coupled to the lever arm. Accordingly, in the event of some failure with respect to the first wire or the second lever arm, the second wire may be used to operate the first lever arm. Further, in some embodiments both wires are used simultaneously to provide increased pulling power on the levers. In addition, in some embodiments coupling different wires to different lever arms is helpful in that increased locking mechanism redundancy of operation is provided.

Figure 19:
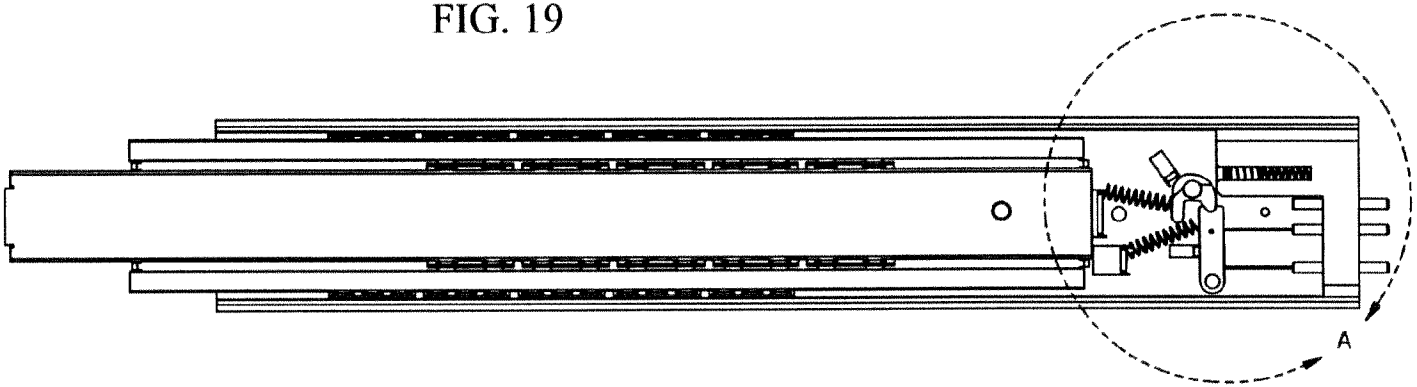
FIGS. 19 and 19A illustrate a further slide and locking mechanism in accordance with aspects of the invention.
Figure 19A:
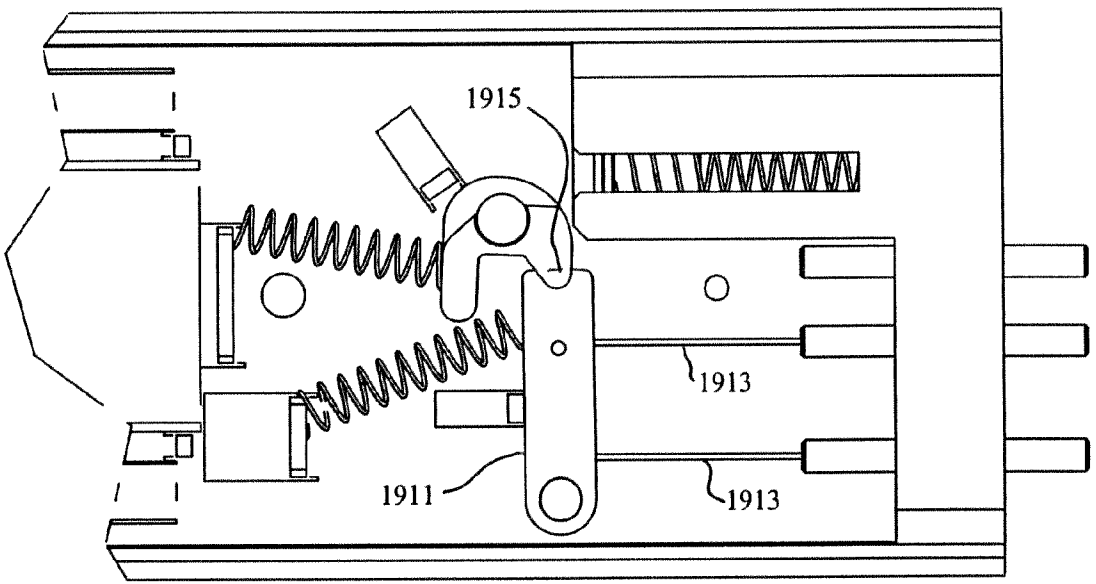

FIG. 19 shows a further slide and locking mechanism in accordance with aspects of the invention. FIG. 19A is a detail view of area A shown in FIG. 19. The embodiment of FIG. 19 generally includes the components of the embodiment of FIG. 15. In the embodiment of FIG. 19 the extendable slides are forward of the lever arm 1911, and the wire or wires 1913 stretches to the rear of the lever arm. Contraction of the wire pulls the top of the lever arm to the rear, allowing a ledge 1915 of the latch receiver to clear the top of the lever arm. Alternatively, the latch receiver may incorporate a tail as in the embodiment of FIG. 15.

Figure 20:
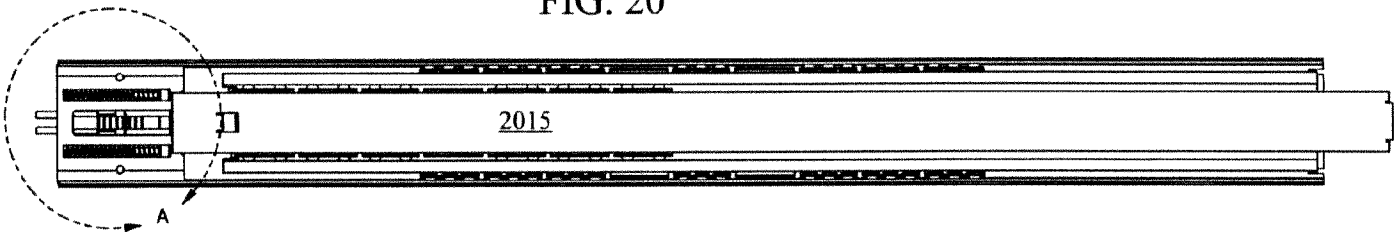
FIGS. 20, 20A, and 20B illustrate a further drawer slide with locking mechanism in accordance with aspects of the invention.
Figure 20B:
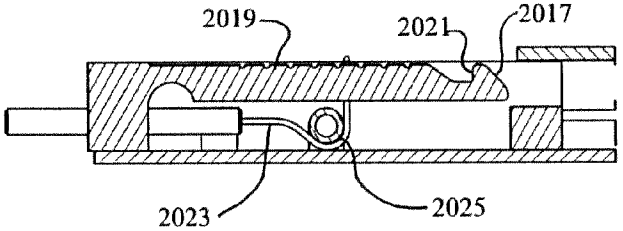
Figure 20A:
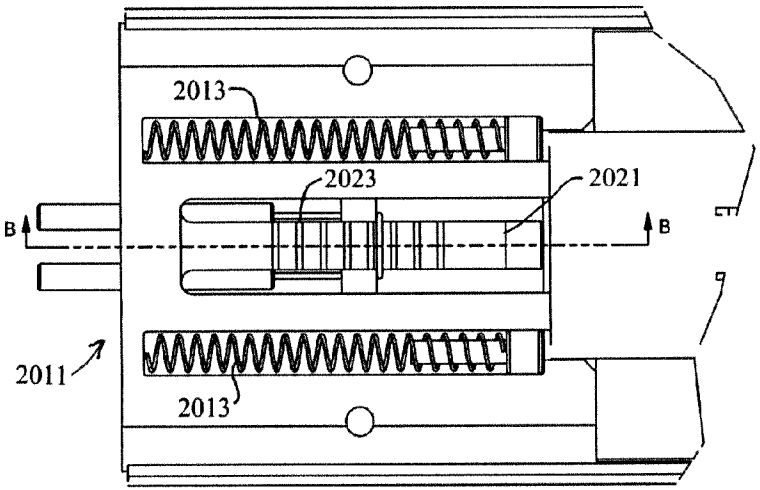

FIG. 20 shows yet a further embodiment of a drawer slide with locking mechanism in accordance with aspects of the invention. FIG. 20A is a detail view of area As shown in FIG. 20; and FIG. 20B is a cross-section view along the line B-B shown in FIG. 20A. The embodiment of FIG. 20, like the embodiment of FIG. 15, includes a three member telescopic drawer slide, although in various embodiments other types of drawer slides may be used. In the embodiment of FIG. 20 a guide block 2011 is placed about a rear of an outer slide member. The guide block optionally includes self-open springs 2013, configured to press forward an inner slide member 2015 and thereby slightly open a drawer coupled to the drawer slide.

The guide block also includes a hook 2017 with a shank 2019 disposed along a length of the guide block, with a head 2021 of the hook transverse to direction of movement of the drawer slide. The inner slide member about its rear includes a flange to catch the hook as the inner slide member is closed. Instead of a flange, the inner slide member may include a punched out portion of its web or other structure to catch or otherwise engage the hook.

The hook is displaceable away from the catch of the inner slide member so as to release the inner slide member and allow the slide to open. Displacement of the hook, in the embodiment of FIG. 20, is provided by contraction of a wire 2023 of a shape memory alloy. The wire passes into the guide block from the rear of the guide block. A post 2025 is provided within the guide block, and the wire passes around the post to provide a ninety degree change in direction of the wire. The wire wraps partly around the shank of the hook, returns to the post, and exits the rear of the guide block.

Contraction of the wire, provided for example by passing a current through the wire as previously discussed, bends the shank of the hook away from the catch of the inner slide member, thereby pulling the head of the hook out of engagement with the inner slide member, releasing the inner slide member and allowing the drawer to open. Subsequent cooling of the wire allows the hook to return to an engageable position, with closing of the inner slide member biasing the hook so as to allow the hook to engage the catch of the inner slide member.

Accordingly, the invention provides a drawer slide and locking mechanism. Although the invention has been described with respect to specific embodiments, it should be recognized that the invention comprises the novel and unobvious claims supported by this disclosure, along with their insubstantial variations.

The invention claimed is:

1. A drawer slide with lock mechanism, comprising:

an outer slide member with an elongate web bounded by raceways;

an inner slide member nested within the raceways and having a latch arm, the inner slide member extendible with respect to the outer slide member, the inner slide member substantially within a volume defined by the outer slide member when the inner slide member is in a non-extended position with respect to the outer slide member, the inner slide member and the outer slide member configured to extensibly couple a drawer to a cabinet;

a latch receiver rotatably mounted with respect to the outer slide member in a travel path of the latch arm;

a lever arm rotatably mounted with respect to the outer slide member, the lever arm rotatable to a position to block rotation of the latch receiver in at least a first direction; and a motor drivably coupled to the lever arm to rotate the lever arm in at least one direction;

wherein the latch receiver includes a basin configured to receive the latch arm.

2. The drawer slide with lock mechanism of claim 1, wherein the motor is drivably coupled to the lever arm by a cam.

3. The drawer slide with lock mechanism of claim 2, wherein the cam is configured to rotate the lever arm out of the position to block rotation of the latch receiver in the at least first direction.

4. The drawer slide with lock mechanism of claim 1, further comprising a lever arm spring biasing the lever arm toward the position to block rotation of the latch receiver in the at least first direction.

5. The drawer slide with lock mechanism of claim 4, wherein the motor is drivably coupled to the lever arm to rotate the lever arm in one direction, and the lever arm spring biases the lever arm in a direction opposite the one direction.

6. The drawer slide with lock mechanism of claim 5, wherein a tail extends from the latch receiver, with the lever arm blocking rotation of the tail when the lever arm is in position to block rotation of the latch receiver in the at least first direction.

7. The drawer slide with lock mechanism of claim 1, wherein the latch arm is a pin.

8. The drawer slide with lock mechanism of claim 7, wherein the pin extends from a web of the inner slide member.

9. The drawer slide with lock mechanism of claim 1 further comprising a spring biasing the latch receiver to a normally open position, in which an opening to the basin is in the travel path of the latch arm.

10. The drawer slide with lock mechanism of claim 1 wherein a thickness of a housing enclosing the latch receiver, the lever arm, and the motor is approximately ½ inch.

11. A drawer slide with lock mechanism, comprising:

an outer slide member with an elongate web bounded by raceways;

an inner slide member nested within the raceways and having a latch arm, the inner slide member extendible with respect to the outer slide member, the inner slide member substantially within a volume defined by the outer slide member when the inner slide member is in a non-extended position with respect to the outer slide member, the inner slide member and the outer slide member configured to extensibly couple a drawer to a cabinet;

a latch receiver rotatably mounted with respect to the outer slide member in a travel path of the latch arm;

a lever arm rotatably mounted with respect to the outer slide member, the lever arm rotatable to a position to block rotation of the latch receiver in at least a first direction; and a motor drivably coupled to the lever arm to rotate the lever arm in at least one direction;

wherein the latch receiver, the lever arm, and the motor are within an operating envelope of the outer and inner slide members.

12. A locking drawer slide, comprising:

a first slide member;

an intermediate slide member extendably coupled to the first slide member along a first axis, the intermediate slide member nested within the first slide member;

a second slide member extendably coupled to the intermediate slide member along the first axis, the second slide member nested within the intermediate slide member;

a pin extending from the second slide member substantially perpendicular to the first axis;

a latch receiver pivotably fixed with respect to the first slide member, the latch receiver positionable in an open position for receiving the pin and positionable in a closed position for retaining the pin;

a lever arm pivotably fixed with respect to the first slide member, the lever arm positionable in a release position for allowing pivoting of the latch receiver and positionable in a locking position for holding the latch receiver in the closed position by blocking rotation of the latch receiver toward the open position;

a cam arranged to pivot the lever arm by pushing a cam follower portion of the lever arm; and a motor rotationally coupled to the cam;

wherein the latch receiver comprises:

a u-shaped portion formed of a first leg and a second leg substantially parallel to the first leg; and a third leg extending outward from the pivot axis of the latch receiver and substantially perpendicular to the first leg and the second leg.

13. The locking drawer slide of claim 12, further comprising a bumper fixed in position with respect to the first slide member and arranged to limit rotation of the latch receiver by obstructing movement of the third leg to locate the latch receiver in the open position for receiving the pin in the u-shaped portion.

14. The locking drawer slide of claim 12, further comprising a latch receiver spring configured to bias the position of the latch receiver towards the open position.

15. The locking drawer slide of claim 12, further comprising a lever arm spring configured to bias the position of the lever arm towards the cam.

16. The locking drawer slide of claim 12, further comprising a release tab attached to the lever aim and extending from a housing enclosing the motor, the cam, and at least portions of the lever arm.

17. The locking drawer slide of claim 12, further comprising a sensor configured to indicate when the latch receiver is in the closed position.

18. The locking drawer slide of claim 17, wherein the sensor comprises a micro switch and an L-shaped actuator, the L-shaped actuator being pivotably fixed with respect to the second slide member and positioned to activate the micro switch when contacted by the third leg when the latch receiver is in the closed position.

19. The locking drawer slide of claim 12, wherein the motor is a reversible motor and is arranged to rotate the cam to position the lever arm in the release position when rotated in a first direction and to rotate the cam to position the lever arm in the locking position when rotated in a second direction.

20. The locking drawer slide of claim 12, further comprising a detent positioned to engage the third leg when the latch receiver is in the closed position.

21. The locking drawer slide of claim 12, further comprising a cam spring configured to bias rotation of the cam away from the lever arm.

22. A locking drawer slide, comprising:

a first slide member;

an intermediate slide member extendably coupled to the first slide member along a first axis, the intermediate slide member nested within the first slide member;

a second slide member extendably coupled to the intermediate slide member along the first axis, the second slide member nested within the intermediate slide member;

a pin extending from the second slide member substantially perpendicular to the first axis;

a latch receiver pivotably fixed with respect to the first slide member, the latch receiver positionable in an open position for receiving the pin and positionable in a closed position for retaining the pin;

a lever arm pivotably fixed with respect to the first slide member, the lever arm positionable in a release position for allowing pivoting of the latch receiver and positionable in a locking position for holding the latch receiver in the closed position by blocking rotation of the latch receiver toward the open position;

a cam arranged to pivot the lever arm by pushing a cam follower portion of the lever arm; and a motor rotationally coupled to the cam;

wherein the pin is attached to the second slide member by a tab extending along the first axis and beyond an end of the second slide member.

23. A locking drawer slide, comprising:

a first slide member;

an intermediate slide member extendably coupled to the first slide member along a first axis, the intermediate slide member nested within the first slide member;

a second slide member extendably coupled to the intermediate slide member along the first axis, the second slide member nested within the intermediate slide member;

a pin extending from the second slide member substantially perpendicular to the first axis;

a latch receiver pivotably fixed with respect to the first slide member, the latch receiver positionable in an open position for receiving the pin and positionable in a closed position for retaining the pin;

a lever arm pivotably fixed with respect to the first slide member, the lever arm positionable in a release position for allowing pivoting of the latch receiver and positionable in a locking position for holding the latch receiver in the closed position by blocking rotation of the latch receiver toward the open position;

a cam arranged to pivot the lever arm by pushing a cam follower portion of the lever arm;

a motor rotationally coupled to the cam; and an open-assist spring positioned to effectively bias the second slide member to extend in a direction that moves the pin away from the latch receiver.

* * * * *

UNITED STATES PATENT AND TRADEMARK OFFICE

CERTIFICATE OF CORRECTION

PATENT NO. : 8,328,299 B2
APPLICATION NO. : 12/768669
DATED : December 11, 2012
INVENTOR(S) : Hashemi et al.

It is certified that error appears in the above-identified patent and that said Letters Patent is hereby corrected as shown below:

In the Specification

In column 1, line 21, delete “hearings,”, and insert --bearings,--, therefor.

In column 5, line 55, delete “aim”, and insert --arm--, therefor.

In column 18, line 18, delete “As”, and insert --as--, therefor.

In column 20, line 53, delete “aim”, and insert --arm--, therefor.

Signed and Sealed this
Twenty-fifth Day of June, 2013

Teresa Stanek Rea
*Acting Director of the United States Patent and Trademark Office*